US009346280B2

(12) United States Patent
Mizutani et al.

(10) Patent No.: US 9,346,280 B2
(45) Date of Patent: May 24, 2016

(54) LIQUID STORING CONTAINER

(71) Applicant: SEIKO EPSON CORPORATION, Tokyo (JP)

(72) Inventors: Tadahiro Mizutani, Nagano (JP); Shigeki Nakata, Nagano (JP); Kenji Matsuyama, Nagano (JP); Kenta Anegawa, Nagano (JP); Atsushi Kobayashi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/517,120

(22) Filed: Oct. 17, 2014

(65) Prior Publication Data

US 2015/0109385 A1 Apr. 23, 2015

(30) Foreign Application Priority Data

Oct. 22, 2013 (JP) ..... 2013-218958

(51) Int. Cl.
*B41J 2/175* (2006.01)

(52) U.S. Cl.
CPC ..... *B41J 2/17556* (2013.01); *B41J 2/17513* (2013.01)

(58) Field of Classification Search
CPC ..... B41J 2/17556; B41J 2/17513
USPC ..... 347/86
See application file for complete search history.

(56) References Cited

U.S. PATENT DOCUMENTS

| | | | | |
|---|---|---|---|---|
| 5,325,119 | A * | 6/1994 | Fong | 347/86 |
| 5,541,632 | A | 7/1996 | Khodapanah et al. | |
| 5,754,207 | A * | 5/1998 | Gragg et al. | 347/86 |
| 5,784,087 | A | 7/1998 | Wallace et al. | |
| 2011/0234719 | A1 | 9/2011 | Mizutani et al. | |

FOREIGN PATENT DOCUMENTS

| | | | |
|---|---|---|---|
| EP | 0924081 | A2 | 6/1999 |
| JP | 06-198904 | A | 7/1994 |
| JP | 08-310004 | A | 11/1996 |
| JP | 11-240171 | A | 9/1999 |
| JP | 2002-144598 | A | 5/2002 |
| JP | 2011-206936 | A | 10/2011 |

* cited by examiner

*Primary Examiner* — Stephen Meier
*Assistant Examiner* — Alexander D Shenderov
(74) *Attorney, Agent, or Firm* — Global IP Counselors, LLP

(57) ABSTRACT

A liquid storing container includes a case, a flexible member, a pressure receiving member, a first urging member, and a second urging member. The case constitutes a part of an inner wall of a liquid containing section configured to store liquid. The flexible member constitutes at least a part of a remaining inner wall of the liquid containing section. The pressure receiving member is arranged between the case and the flexible member. The first urging member is provided between the pressure receiving member and the case, and one end is connected to the pressure receiving member to urge the pressure receiving member from the case to the flexible member. The second urging member is provided between the pressure receiving member and the case, and one end is connected to the pressure receiving member to urge the pressure receiving member from the case to the flexible member.

15 Claims, 27 Drawing Sheets

LIQUID STORING CONTAINER

CROSS-REFERENCE TO RELATED APPLICATIONS

This application claims priority to Japanese Patent Application No. 2013-218958 filed on Oct. 22, 2013. The entire disclosure of Japanese Patent Application No. 2013-218958 is hereby incorporated herein by reference.

BACKGROUND

1. Technical Field

The present invention relates to a liquid storing container, etc.

2. Related Art

In an ink jet printer which is an example of a liquid ejecting device, a printing is performed to a print medium by ejecting ink, which is an example of liquid, from a print head to a print medium such as a print sheet, etc. In the ink-jet printer, it is well-known that the ink is supplied from an ink cartridge which is an example of a liquid storing container. In such ink cartridge, conventionally, the ink is stored in a liquid containing section having a structure in which a sheet-like member (film) is welded to a container-shaped case (see e.g., Japanese Laid-open Patent Application Publication No. 2011-206936). In the ink cartridge described in Japanese Laid-open Patent Application Publication No. 2011-206936, a structure in which an urging-force is applied to a sheet-like member through a pressure receiving plate from a conically-shaped coil spring arranged in the liquid containing section is employed. In this ink cartridge, when the ink in the liquid containing section is consumed, a pressure inside the liquid containing section is reduced so that the volume of the liquid containing section is decreased. At this point, the pressure receiving plate is displaced in a direction approaching to the bottom of the container-shaped case by which the conically-shaped coil spring is compressed. The volume of the liquid containing section is decreased by which the pressure receiving plate is displaced and the sheet-like member is deformed in a direction approaching to the bottom of the container-shaped case.

In the structure described in the aforementioned Japanese Laid-open Patent Application Publication No. 2011-206936, or Japanese Laid-open Patent Application Publication No. H8-310004, a plate material such as a pressure receiving plate, a pressure plate, etc. is supported by a spring that urges the plate material so that there is a problem that a position or a posture of the plate material easily varies.

SUMMARY

The present invention was made to solve at least a part of the aforementioned problem, and can be actualized as the following embodiments or applied examples.

A liquid storing container that has a liquid containing section configured to store liquid and that is configured to supply the liquid in the liquid containing section to a liquid ejecting device, comprises a case constituting a part of an inner wall of the liquid containing section; a flexible member having flexibility and constituting at least a part of a remaining inner wall of the liquid containing section; a pressure receiving member arranged between the case and the flexible member in the liquid containing section; a first urging member provided between the pressure receiving member and the case, one end being connected to the pressure receiving member, the first urging member being configured to urge the pressure receiving member from the case to the flexible member; and a second urging member provided between the pressure receiving member and the case, one end being connected to the pressure receiving member, the second urging member being configured to urge the pressure receiving member from the case to the flexible member.

In the liquid storing container in this applied example, the pressure receiving member can be supported by at least two urging members of the first urging member and the second urging member. Thus, for example, it becomes easy to stabilize the position or the posture of the pressure receiving member in comparison with the case that the pressure receiving member is suppressed by one urging member. Therefore, in this liquid storing container, the variability of the position or the posture of the pressure receiving member is easily suppressed.

In the aforementioned liquid storing container, the pressure receiving member is formed in a plate shape, and each of the first urging member and the second urging member has a first leg and a second leg, one end of the first leg being connected to the pressure receiving member, the first leg extending in a state of an inclination with respect to the pressure receiving member, the other end of the first leg being connected to one end of the second leg, and the second leg extending in a state of an inclination with respect to the pressure receiving member, and the first leg is inclined in a direction approaching from the pressure receiving member to the case; and the second leg is inclined in a direction approaching from the first leg to the case and is further inclined in an opposite direction from a direction of the inclination of the first leg.

In this applied example, the first urging member and the second urging member can be respectively expanded and contracted by a bending and stretching movement between the pressure receiving member and the first leg, and a bending and stretching movement between the first leg and the second leg. Thus, the expansion and contraction direction in each of the first urging member and the second urging member is specified by the bending and stretching direction between the pressure receiving member and the first leg and the bending and stretching direction between the first leg and second leg. Therefore, the movement direction of each of the first urging member and the second urging member can be limited. That is, the movement direction in each of the first urging member and the second urging member is easily limited to the expansion and contraction direction of each of the first urging member and the second urging member. As a result, the displacement direction of the pressure receiving member is easily limited to the expansion and contraction direction of the first urging member and the second urging member so that the inclination of the pressure receiving member is easily suppressed. Accordingly, it becomes easy to stabilize the position or the posture of the pressure receiving member.

In the aforementioned liquid storing container, a joint portion jointed between the pressure receiving member and the first leg of the first urging member and a joint portion jointed between the pressure receiving member and the first leg of the second urging member are positioned in a side opposing to each other through a center of gravity of the pressure receiving member.

In this applied example, the pressure receiving member can be supported in two places through the center of gravity of the pressure receiving member so that it becomes easy to stabilize and support the pressure receiving member. Therefore, it becomes easy to further stabilize the position or the posture of the pressure receiving member.

In the aforementioned liquid storing container, each of the first urging member and the second urging member further has a third leg which connected to the other end of the second leg and extends in a state of an inclination with respect to the pressure receiving member, and the third leg is inclined in a direction approaching from the second leg to the case, and is further inclined in an opposite direction from a direction of the inclination of the second leg.

In this applied example, the first urging member and the second urging member are respectively expanded and contracted by the bending and stretching movement between the pressure receiving member and the first leg, the bending and stretching movement between the first leg and the second leg, and the bending and stretching movement between the second leg and the third leg. Thus, the expansion and contraction direction in each of the first urging member and the second urging member is specified by the bending and stretching direction between the pressure receiving member and the first leg, the bending and stretching direction between the first leg and the second leg, and the bending and stretching direction between the second leg and the third leg. Therefore, the movement direction in each of the first urging member and the second urging member can be limited. That is, the movement direction in each of the first urging member and the second urging member is easily limited in the expansion and contraction direction of each of the first urging member and the second urging member. As a result, the displacement direction of the pressure receiving member is easily limited in the expansion and contraction direction of the first urging member or the second urging member so that the inclination of the pressure receiving member is easily suppressed. Accordingly, it becomes easy to stabilize the position or the posture of the pressure receiving member.

In the aforementioned liquid storing container, an inclination direction of the first leg of the first urging member and an inclination direction of the first leg of the second urging member are opposite to each other.

In this applied example, the inclination direction of the first leg of the first urging member and the inclination direction of the first leg of the second urging member are the opposite direction to each other so that the displacement of the pressure receiving member in the direction intersecting the direction of which the first urging member and the second urging member urge the pressure receiving member is easily suppressed.

In the aforementioned liquid storing container, the first leg extends in a direction from an outer side of the pressure receiving member to a center side as the pressure receiving member is viewed in the plane view, and is also inclined in a direction approaching to the case while being directed from the outer side of the pressure receiving member to the center side.

In this applied example, a distance between the joint portion with respect to the pressure receiving member of the first leg in the first urging member and the joint portion with respect to the pressure receiving member of the first leg in the second urging member can be longer in comparison with the case the first leg extends in the direction from the center side of the pressure receiving member to the outside. Thus, the pressure receiving member can be supported in two places having a distance to each other so that it becomes easy to stabilize and support the pressure receiving section. Therefore, it becomes easy to further stabilize the position or the posture of the pressure receiving section.

In the aforementioned liquid storing container, the third leg of the first urging member and the third leg of the second urging member are connected to each other.

In this applied example, the third leg of the first urging member and the third leg of the second urging member are connected to each other so that the variability of the distance between the two third legs is easily suppressed.

In the aforementioned liquid storing container, the third leg of the first urging member and the third leg of the second urging member are connected to each other through a joint member, and the joint member is connected to the case.

In this applied example, there is the joint member so that it is easy to connect to the case.

In the aforementioned liquid storing container, the third leg of the first urging member and the third leg of the second urging member are connected to the case.

In this applied example, the third leg of the first urging member and the third leg of the second urging member are connected to the case so that the position of the pressure receiving member is easily specified. Therefore, it becomes easy to further stabilize the position or the posture of the pressure receiving member.

In the aforementioned liquid storing container, the second leg has two legs.

In this applied example, the second leg is configured by two legs so that the oscillation of the pressure receiving member in the direction aligning the two legs is easily suppressed. Therefore, it becomes easy to further stabilize the position or the posture of the pressure receiving member.

In the aforementioned liquid storing container, the third leg has two legs.

In the applied example, the third leg is configured by two legs so that the oscillation of the pressure receiving member in the direction aligning the two legs is easily suppressed. Therefore, it becomes easy to further stabilize the position or the posture of the pressure receiving member.

In the aforementioned liquid storing container, at least one of the first leg of the first urging member and the first leg of the second urging member has two legs.

In this applied example, at least one of the first leg of the first urging member and the first leg of the second urging member is configured by two legs so that the pressure receiving member can be supported in at least three places. Therefore, it becomes easy to further stabilize the position or the posture of the pressure receiving member.

In the aforementioned liquid storing container, the pressure receiving member, the first urging member, and the second urging member are mutually and integrally formed.

In this applied example, the pressure receiving member, the first urging member, and the second urging member are mutually and integrally formed so that the number of components can be reduced.

In the aforementioned liquid storing container, a third urging member is provided between the pressure receiving member and the case, one end is connected to the pressure receiving member, the third urging member is configured to urge the pressure receiving member from the case to the flexible member.

In this applied example of the liquid storing container, the pressure receiving member can be supported by at least three urging members of the first urging member, the second urging member, and the third urging member. Thus, it becomes easy to stabilize the position or the posture of the pressure receiving member in comparison with, for example, the case that the pressure receiving member is supported by one urging member. Therefore, in this liquid storing container, the variability of the position or the posture of the pressure receiving member is easily suppressed.

In the aforementioned liquid storing container, the pressure receiving member has an opening and is formed in an annular shape, and the pressure receiving member, the first urging member and the second urging member are not mutually overlapped as the pressure receiving member is viewed in a plane view.

In this applied example, the liquid in the liquid containing section enables to contact to the flexible member through the opening of the pressure receiving member. Therefore, for example, in the case that the liquid in the liquid containing section is oscillated, the movement of the oscillated liquid is easily absorbed by the flexible member. That is, in the case that the liquid in the liquid containing section is oscillated, the impact by the oscillated liquid can be absorbed by the flexible member. Therefore, in the case that the liquid in the liquid containing section is oscillated, it becomes easy to suppress that the liquid in the liquid containing section is foamed.

BRIEF DESCRIPTION OF THE DRAWINGS

Referring now to the attached drawings which form a part of this original disclosure.

DETAILED DESCRIPTION OF EXEMPLARY EMBODIMENTS

As an example of the liquid ejecting system 1, the embodiments will be explained with reference to the figures. In each of the following figures, the scale of each member, etc., is shown so as to be different from the actual scale to make each member, etc., recognizable size.

Figure 1:
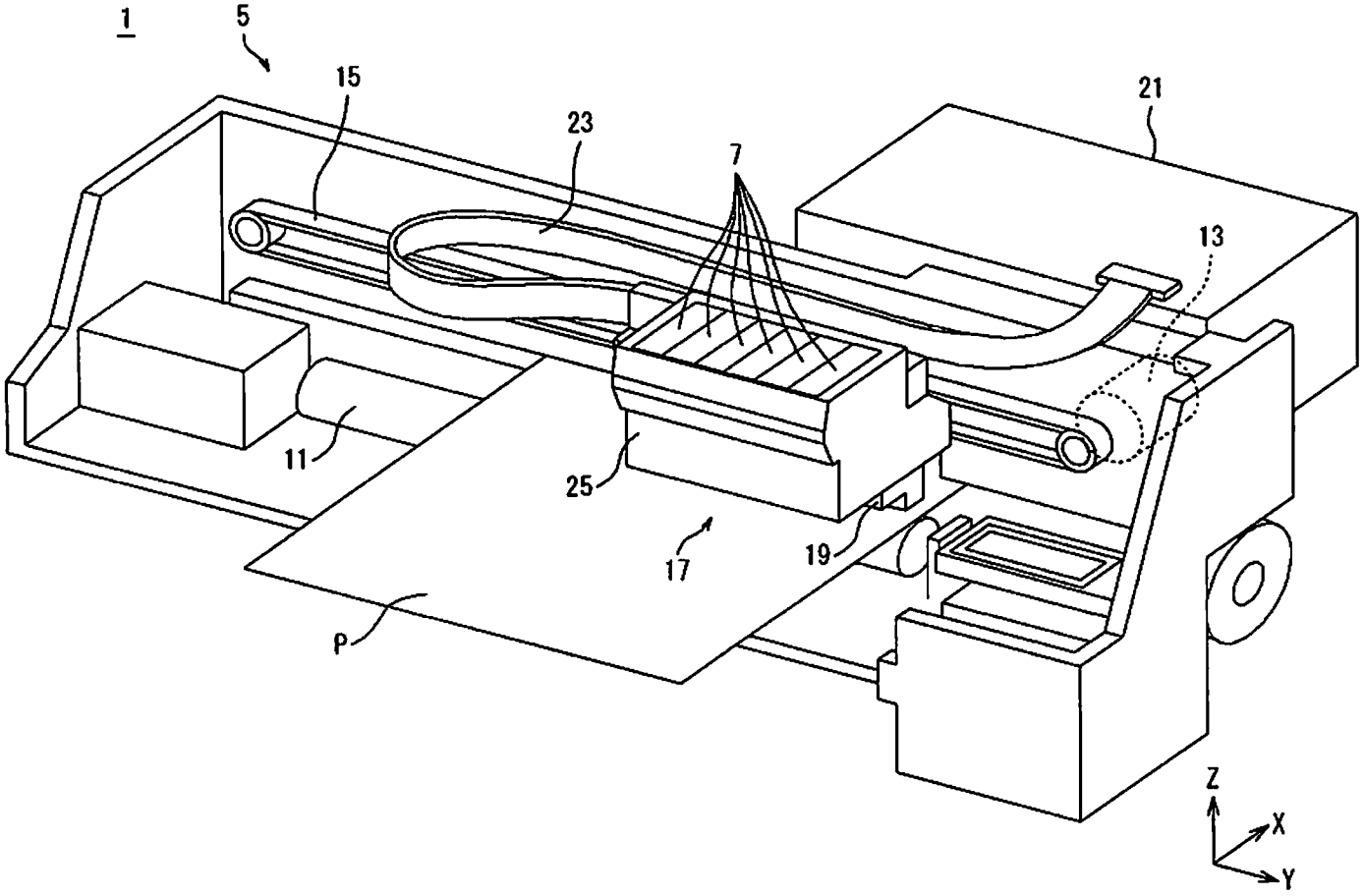
FIG. 1 is a perspective view showing a structure of a liquid ejecting system according to the present embodiment.

As shown in FIG. 1, a liquid ejecting system according to the present embodiment is provided with a printer 5 and a cartridge 7, which is an example of a liquid storing container. The cartridge 7 enables to store ink which is an example of liquid. XYZ axes, which are the coordinate axes and are mutually orthogonal to each other, are shown in FIG. 1. Hereinafter, the XYZ axes are shown in the drawings if necessary. In the present embodiment, in a state that the printer 5 is arranged on a horizontal plane surface (XY plane surface) that is specified by the X-axis direction and the Y-axis direction, this indicates in a state that the printer 5 is in use. The Z-axis direction is the direction being orthogonal to the horizontal plane surface. In the state that the printer 5 is in use, the Z-axis direction becomes a vertical direction. Also, in the state that the printer 5 is in use, in FIG. 1, −Z-axis direction becomes a vertically downward direction. In the respective XYZ axes, the direction of an arrow indicates + (positive) direction, and the opposite direction of the arrow direction indicates − (negative) direction.

The printer 5 is provided with a sub-scanning feeding mechanism, a main scanning feeding mechanism, and a head driving mechanism. The sub-scanning feeding mechanism conveys a print sheet P in the sub-scanning direction by using a paper feeding roller 11 powered by a paper feeding motor which is not shown. The main scanning feeding mechanism reciprocates the carriage 17 connected to the driving belt 15 in the main scanning direction by using the power of the carriage motor 13. The main scanning direction of the printer 5 is the Y-axis direction, and the sub-scanning direction is the X-axis direction. The head driving mechanism executes the ejection of the ink, which is the liquid, and the dot formation by driving the print head 19 provided in the carriage 17. The printer 5 is further provided with a control section 21 that controls the aforementioned respective mechanisms. The print head 19 is connected to the control section 21 through the flexible cable 23.

The carriage 17 is provided with a holder 25 and a print head 19. The holder 25 is configured in the manner of being capable of mounting a plurality of cartridges 7, and the print head 19 is upwardly arranged. In the present embodiment, six types of cartridges 7 of black, yellow, magenta, cyan, light magenta, and light cyan are respectively mounted in the holder 25. The respective six cartridges 7 are configured to be detachable from the holder 25. The types of the cartridges 7 are not limited to the aforementioned six types so that any other types can be employed. Further, the number of the cartridges 7, which are detachable from the holder 25, is not limited to six so that any number which is more than or equal to one can be employed. The print head 19 functions as a liquid ejecting section that ejects the ink by ejecting the ink.

Figure 2:
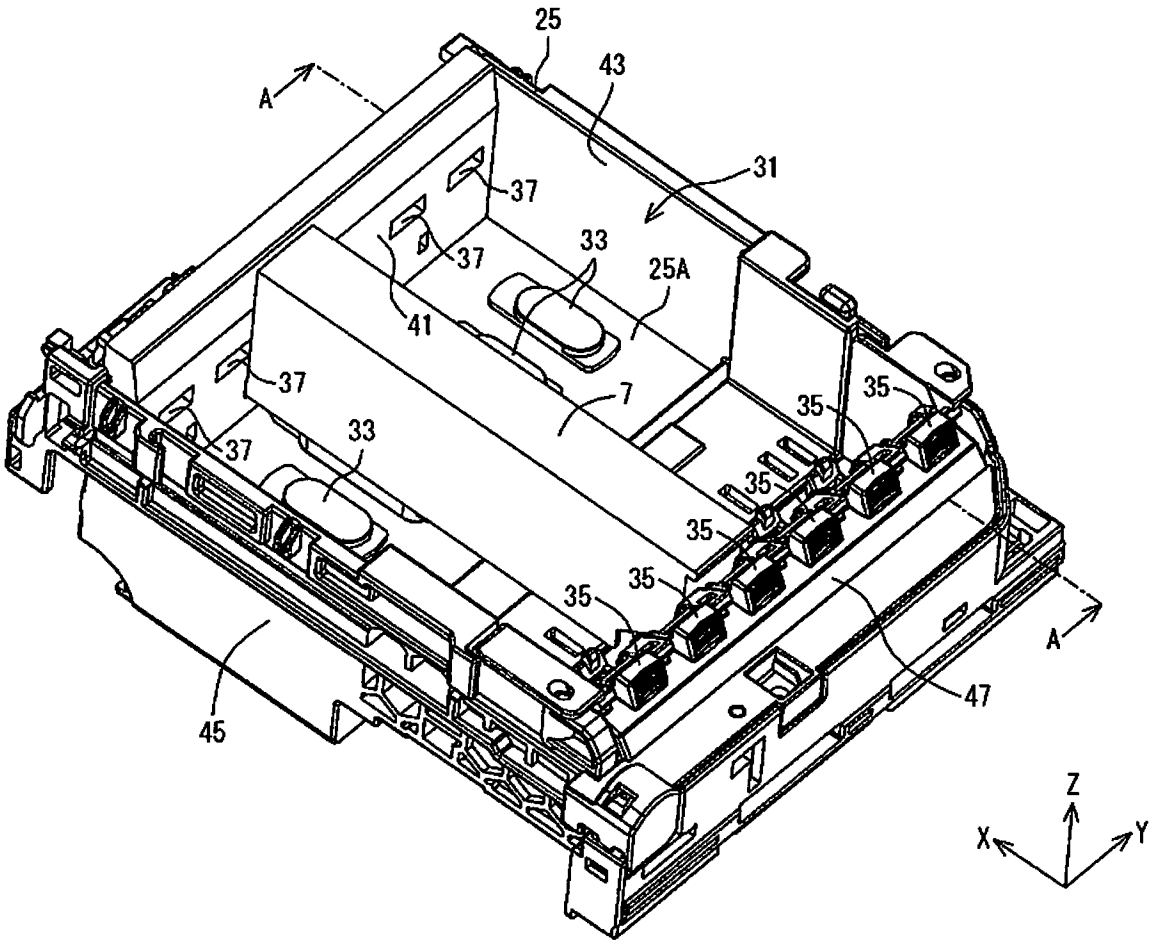
FIG. 2 is a perspective view showing a structure of a holder according to the present embodiment.

As shown in FIG. 2, the holder 25 is provided with a recessed section 31. The cartridge 7 is mounted in the recessed section 31 of the holder 25. In the present embodiment, the six cartridges 7 can be stored in the recessed section 31. In the present embodiment, the six cartridges 7 mounted in the recessed section 31 are stored in the recessed section 31 in the state that a space is mutually provided. In the recessed section 31, the respective corresponded mount positions of the six cartridges 7 mounted in the recessed section 31 are specified. The six mount positions are aligned in the Y-axis direction in the recessed section 31. That is, the six cartridges 7 are stored in the recessed section 31 in the state of being aligned in the Y-axis direction.

In the recessed section 31, six installation sections 33 are provided in the bottom 25A of the holder 25. The six installation sections 33 are respectively provided in each of the mount positions. That is, the six installation sections 33 are provided to correspond to the respective six cartridges 7, respectively, which are mounted in the recessed section 31. Therefore, in the recessed section 31, the six installation sections 33 are aligned in the Y-axis direction. Also, the six cartridges 7 mounted in the holder 25 are aligned along the Y-axis direction in the recessed section 31. FIG. 2 shows in the state that one cartridge 7 is mounted in the holder 25.

Further, six levers 35 and six engaging holes 37 are provided in the holder 25. In the present embodiment, one lever 35 and one engaging hole 37 are provided in each mount position of the cartridge 7. The six levers 35 are aligned in the Y-axis direction. The six engaging holes 37 are aligned in the Y-axis direction.

The levers 35 are provided in the −X-direction side of the installation sections 33. In the holders 25, a side wall 41 is provided in the opposite side (+X-axis direction side) of the levers 35 through the installation sections 33. Further, a side wall 43 and a side wall 45 are provided in the opposite positions in the Y-axis direction through the installation sections 33. The side wall 43 is positioned in the +Y-axis direction side of the bottom 25A. The side wall 45 is positioned in the −Y-axis direction of the bottom 25A. Further, a side wall 47 is provided in the position opposing to the side wall 41 through the levers 35 in the Y-axis direction. The side wall 41, the side wall 43, the side wall 45, and the side wall 47 are respectively projected from the bottom 25A in the +Z-axis direction. The bottom 25A is surrounded by the side wall 41, the side wall 43, the side wall 45, and the side wall 47. Therefore, the recessed section 31 is partitioned.

Figure 3:
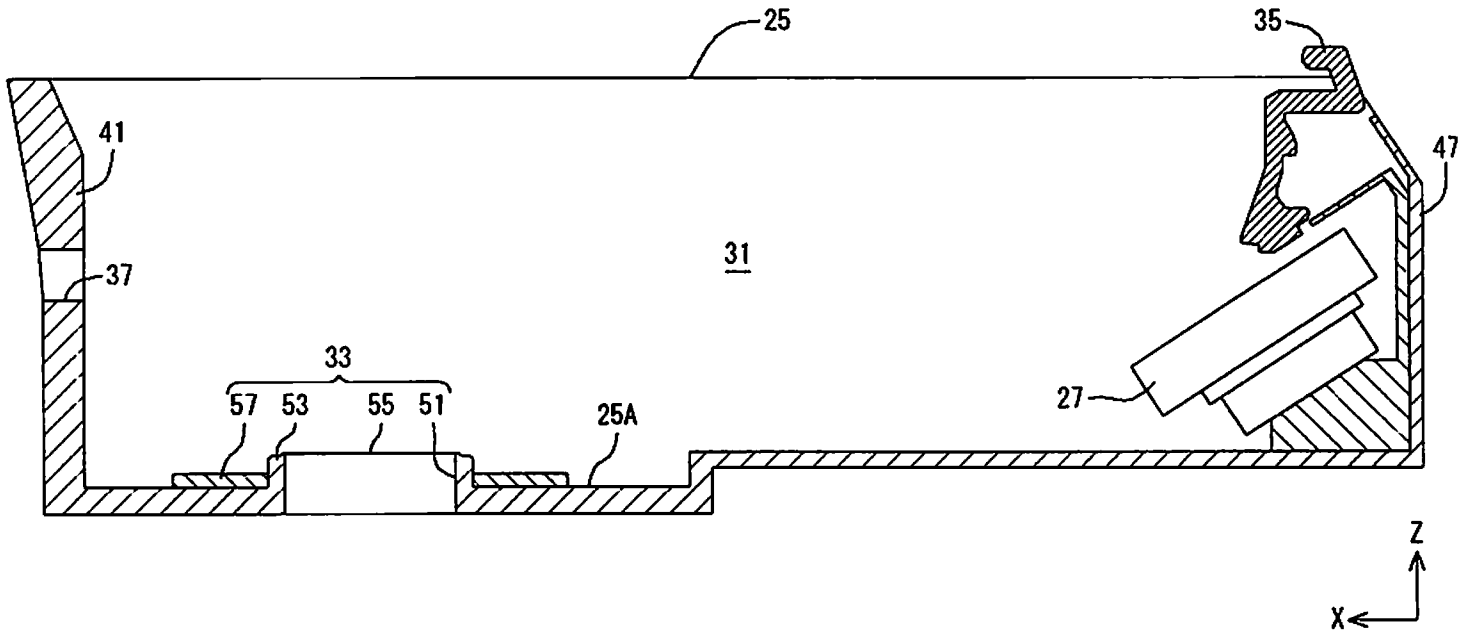
FIG. 3 is a cross-sectional view in an A-A line in FIG. 2.

As shown in FIG. 3 that is a cross-sectional view in the A-A line in FIG. 2, the levers 35 are provided between the side wall 47 and the side wall 41. FIG. 3 corresponds to the cross-sectional view when the holder 25 is cut in the XZ plane surface that passes through the installation section 33. The lever 35 is provided between the side wall 47 and the installation section 33. The lever 35 fixes the cartridge 7 mounted in the holder 25. The operator can remove the cartridge 7 from the holder 25 by releasing the fixation of the cartridge 7 by the lever 35. The engaging hole 37 is provided in the side wall 41. The engaging hole 37 penetrates through the side wall 41.

The installation section 33 is provided between the lever 35 and the side wall 41 in the bottom 25A. The installation section 33 includes a flow channel 51, a cylindrical section 53, a filter 55, and a packing 57. The flow channel 51 is a passage of the ink supplied from the cartridge 7, and is provided as an opening that penetrates through the bottom 25A. The cylindrical section 53 is provided in the bottom 25A, and is projected in a direction to become a convex in the +Z-direction from the bottom 25A. The cylindrical section 53 surrounds the flow channel 51 inside the recessed section 31. The filter 55 covers the cylindrical section 53, and it covers the opening inside the recessed section 31 of the flow channel 51 from the cylindrical section 53 side. The packing 57 is provided in the bottom 25A, and it surrounds the cylindrical section 53 inside the recessed section 31. The packing 57 is configured by, for example, an elastic material such as rubber, elastomer, etc.

Figure 4:
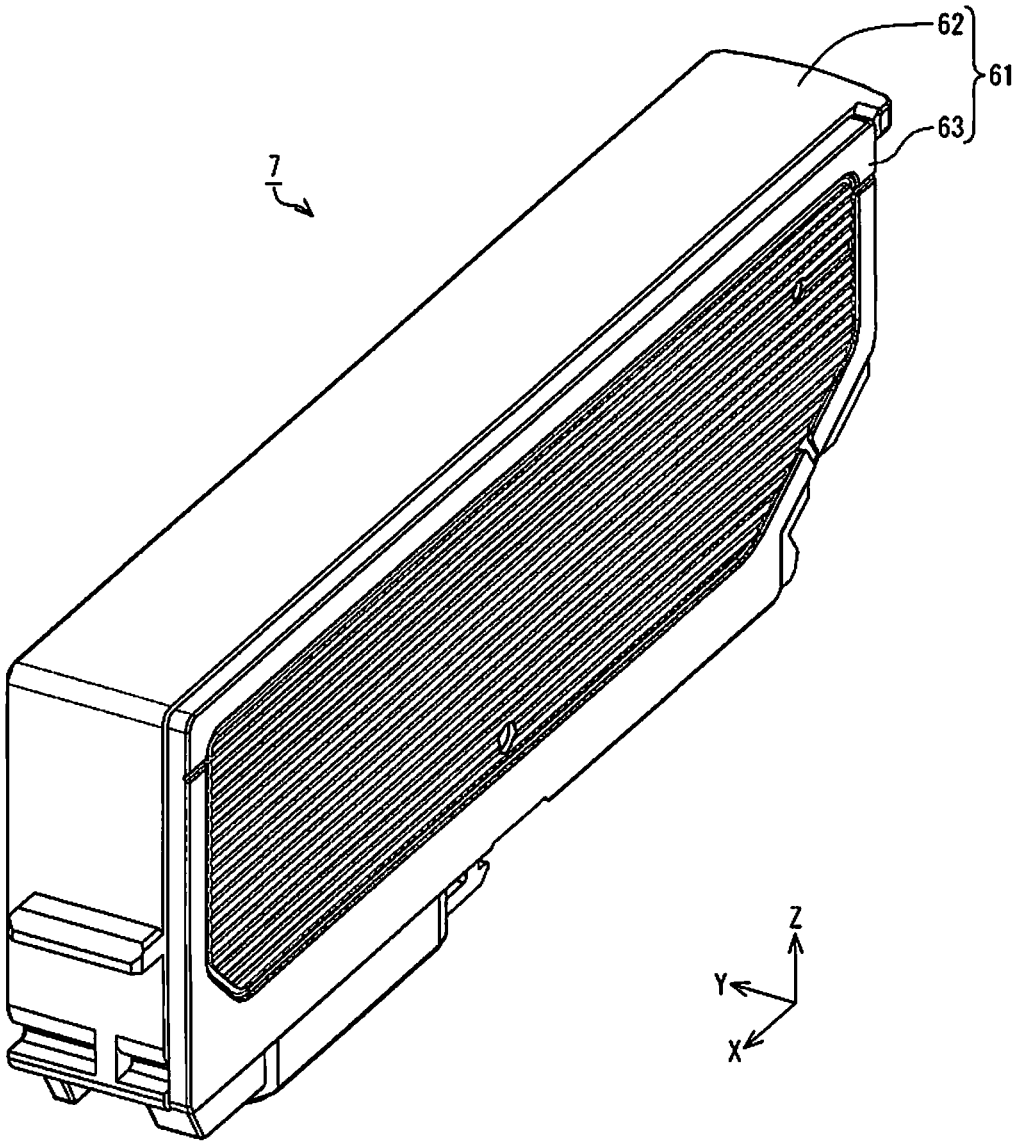
FIG. 4 is a perspective view showing a cartridge according to the present embodiment.
Figure 5:
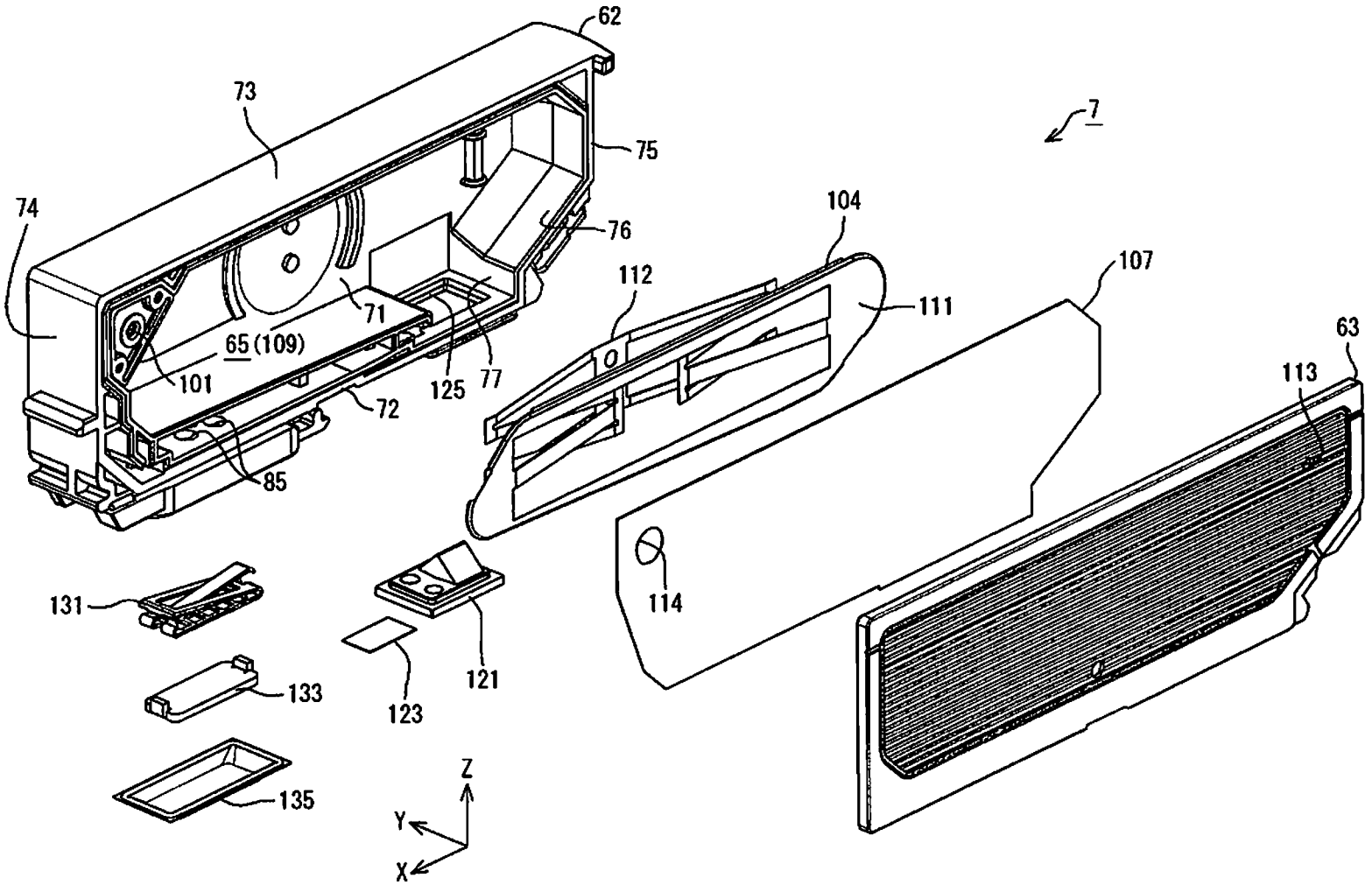
FIG. 5 is an exploded perspective view showing a structure of a cartridge according to the present embodiment.

As shown in FIG. 4, the cartridge 7 is provided with a case 61. The case 61 configures an outer shell of the cartridge 7. The case 61 includes the first case 62 and the second case 63. In the present embodiment, the cartridge 7 is configured by the first case 62 and the second case 63. As shown in FIG. 5, the first case 62 is provided with the first wall 71, the second wall 72, the third wall 73, the fourth wall 74, the fifth wall 75, the sixth wall 76, and the seventh wall 77. The each of the second wall 72 to the seventh wall 77 intersects with the first wall 71. The second wall 72 to the seventh wall 77 are respectively projected toward the −Y-direction side from the first wall 71, that is, toward the second case 63 side from the first wall 71.

The second wall 72 and the third wall 73 are provided in the positions opposing to each other through the first wall 71 in the Z-axis direction. The fourth wall 74 and the fifth wall 75 are provided in the positions opposing to each other through the first wall 71 in the X-direction. The fourth wall 74 and the fifth wall 75 respectively intersect with the third wall 73. Further, the fourth wall 74 intersects with the second wall 72 in the opposite side from the third wall 73 side.

The sixth wall 76 intersects with the fifth wall 75 in the second wall 72 side of the fifth wall 75 in the Z-axis direction, that is, in the opposite side from the third wall 73 side of the fifth wall 75. The seventh wall 77 intersects with the sixth wall 76 in the opposite side from the fifth wall 75 side of the sixth wall 76. Further, the seventh wall 77 intersects with the second wall 72 in the opposite side from the fourth wall 74 side of the second wall 72. The sixth wall 76 is inclined with respect to the fifth wall 75 and the second wall 72, respectively. The sixth wall 76 is inclined in the direction approaching to the fourth wall 74 as it gets closer to the second wall 72 side from the third wall 73 side.

With the aforementioned configuration, the first wall 71 is surrounded by the second wall 72 to the seventh wall 77. The second wall 72 to the seventh wall 77 are projected in the −Y-axis direction from the first wall 71. Therefore, the first case 62 is configured in a recessed-shape by the second wall 72 to the seventh wall 77 such that the first wall 71 is placed as the bottom. The recessed section 65 is configured by the first wall 71 to the seventh wall 77. The recessed section 65 is configured in the direction to become a concave in the +Y-axis direction. The recessed section 65 opens in the −Y-axis direction, that is, in the direction of the second case 63 side. The recessed section 65 is sealed by the sheet member 107 which will be described later. The ink is stored in the recessed section 65 that is sealed by the sheet member 107. Therefore, the recessed section 65 functions as the storage section of the ink. Hereinafter, the surface inside the recessed section 65 denotes as an inner surface 67.

Figure 6:
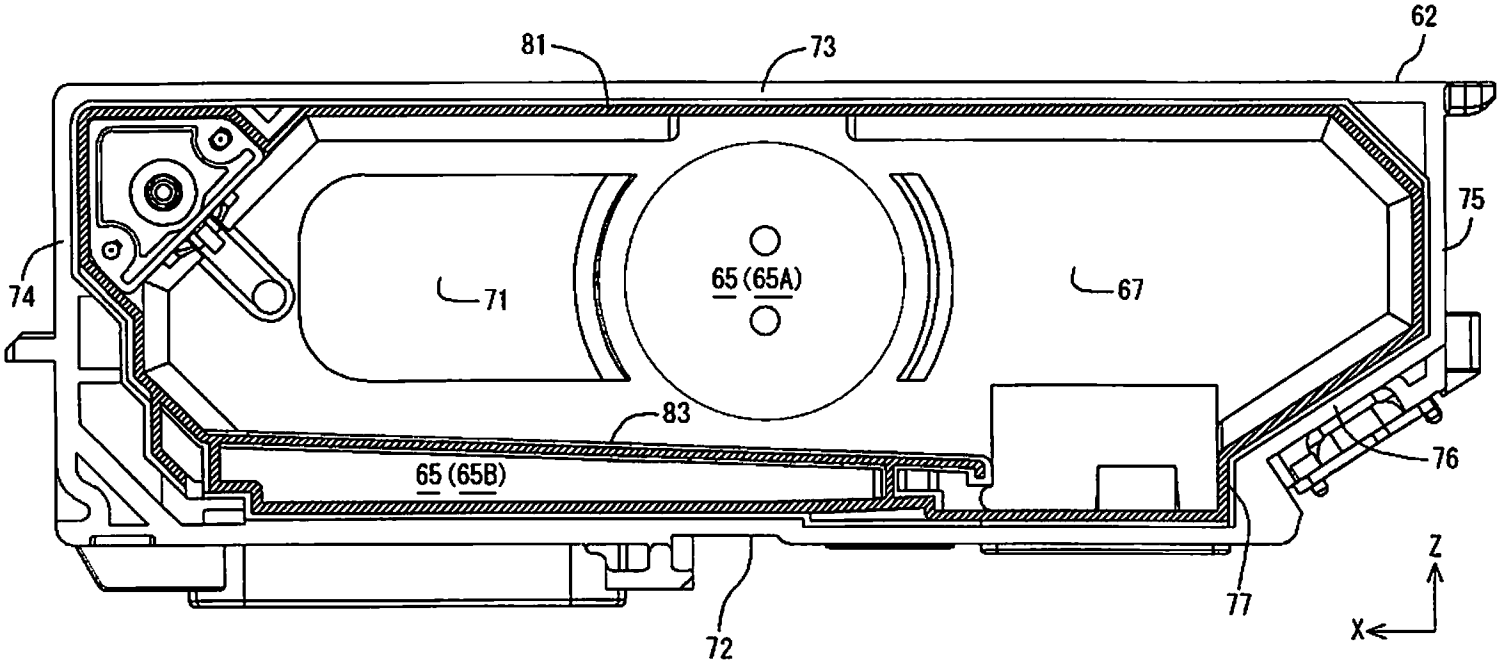
FIG. 6 is a plane view showing the first case according to the present embodiment.

In the first case 62, as shown in FIG. 6, a joint section 81 is provided along the outline of the recessed section 65. The joint section 81 is provided along the second wall 72 to the seventh wall 77. Also, in the first case 62, a partition wall 83 that partitions the recessed section 65 into the first recessed section 65A and the second recessed section 65B is provided. The joint section 81 is also provided in the partition wall 83. In FIG. 6, a hatching is shown in the joint section 81 to simply show the structure. Within the recessed section 65, the region that is surrounded by the third wall 73, the fifth wall 75, the seventh wall 77, a part of the second wall 72, the partition wall 83, and a part of the fourth wall 74 is the first recessed section 65A. Further, within the recessed section 65, the region that is surrounded by the other part of the second wall 72, the partition wall 83, and the other part of the fourth wall 74, that is, the region that excludes the first recessed section 65A from the recessed section 65 is the second recessed section 65B.

Figure 7A:
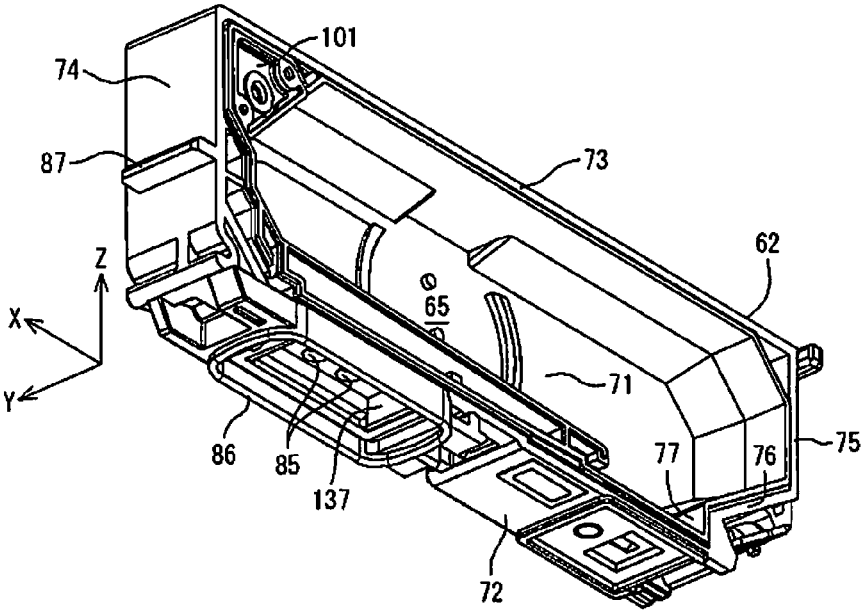
FIGS. 7A and 7B are perspective views showing the first case according to the present embodiment.

Further, in the second wall 72, as shown in FIG. 5, supply holes 85 that penetrate through between the inside of the recessed section 65 and the outside of the first case 62 are provided. The ink stored in the recessed section 65 is discharged to the outside of the cartridge 7 from the supply holes 85. Also, in the opposite side from the recessed section 65 side of the second wall 72, that is, the outside of the second wall 72, as shown in FIG. 7A, a surrounding wall 86 that surrounds the supply holes 85 is provided. The surrounding wall 86 is projected from the second wall 72 in the direction of the opposite side from the third wall 73 side (−Z-axis direction side). The surrounding wall 86 surrounds the supply holes 85 from the outside.

Figure 7B:
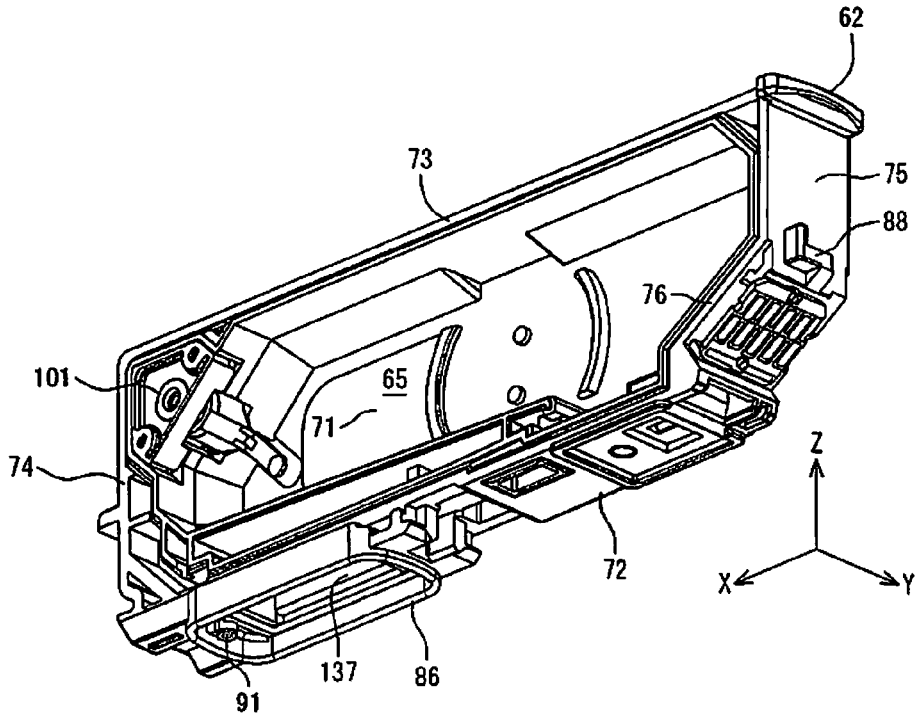

In the fourth wall 74, a projecting section 87 is provided. The projecting section 87 is projected from the fourth wall 74 in the direction of the opposite side from the fifth wall 75 side (+X-axis direction side). In the Z-axis direction, the projecting section 87 is positioned between the second wall 72 and the third wall 73. The projecting section 87 fits to the engaging hole 37, which is shown in FIG. 3, in the state that the cartridge 7 is mounted in the holder 25. Also, as shown in FIG. 7B, a projecting section 88 is provided in the fifth wall 75. The projecting section 88 is projected from the fifth wall 75 in the direction of the opposite side from the fourth wall 74 side (−X-axis direction side). The projecting section 88 is locked by the lever 35, which is shown in FIG. 3, in the state that the cartridge 7 is mounted in the holder 25. Therefore, the cartridge 7 can be fixed in the holder 25. In the second wall 72, a communication hole 91 is provided in the region surrounded by the surrounding wall 86 and in the region that is the outside of the supply holes 85. The communication hole 91 penetrates through between the inside of the recessed section 65 and the outside of the first case 62.

Further, as shown in FIG. 5, the cartridge 7 is provided with a valve unit 101, an urging plate 104, and a sheet member 107. The sheet member 107, which is an example of a flexible member, is formed by a synthetic resin (e.g., nylon, polypropylene, etc.) and has flexibility. The sheet member 107 is provided in the first case 62 side of the second case 63. The sheet member 107 is bonded to the joint section 81 of the first case 62. In the present embodiment, the sheet member 107 is bonded to the joint section 81 by welding. Therefore, the recessed section 65 of the first case 62 is sealed by the sheet member 107. The region that is surrounded by the recessed section 65 and the sheet member 107 is called as a liquid containing section 109. The ink is stored in the recessed section 65, which is sealed by the sheet member 107, that is, in the liquid containing section 109. Therefore, in the present embodiment, the sheet member 107 configures a part of the inner wall of the liquid containing section 109. Also, the first case 62 also configures a part of the inner wall of the liquid containing section 109.

As described above, in the first case 62, as shown in FIG. 6, the recessed section 65 is partitioned into the first recessed section 65A and the second recessed section 65B by the partition wall 83. Therefore, when the sheet member 107 is bonded to the joint section 81, the liquid containing section 109 is partitioned into the first liquid containing section 109A and the second liquid containing section 109B. The first liquid containing section 109A corresponds to the first recessed section 65A. The second liquid containing section 109B corresponds to the second recessed section 65B. As described above, the sheet member 107 has flexibility. Therefore, the volume of the first liquid containing section 109A can be changed. The sheet member 107 is bonded to the first case 62 in the state that it is pressed and spread along the inner surface 67 of the recessed section 65 in advance so as to easily change the volume of the first liquid containing section 109A.

As shown in FIG. 5, the urging plate 104 is provided in the first case 62 side of the sheet member 107, and is stored in the liquid containing section 109. The urging plate 104 is formed by, for example, a plate material such as a stainless steel plate. The urging plate 104 is provided with a pressure receiving section 111, which is an example of a pressure receiving member, and an urging section 112. The pressure receiving section 111 is formed in a plate shape, and it is provided in the sheet member 107 side in the urging plate 104. Therefore, the pressure receiving section 111 can exist between the urging section 112 and the sheet member 107. In the liquid containing section 109, the pressure receiving section 111 is contacted to the sheet member 107.

The urging section 112 urges the pressure receiving section 111 toward the sheet member 107 side. In other words, the urging section 112 urges the pressure receiving section 111 in the −Y-axis direction. That is, the urging section 112 urges the pressure receiving section 111 in the direction increasing the volume of the liquid containing section 109. The second case 63 is provided in the opposite side from the pressure receiving section 111 side of the sheet member 107. The second case 63 is attached to the first case 62 to cover the sheet member 107. Therefore, the sheet member 107 is protected from the outside.

The valve unit 101 is provided inside the recessed section 65. The sheet member 107 entirely covers the recessed section 65 and the valve unit 101. In the portion where the sheet member 107 overlaps to the valve unit 101, an air hole 114 is formed. The air hole 114 is sealed by the valve unit 101. Also, in the second case 63, an atmosphere communication hole 113 is provided. Also, a space between the sheet member 107 and the second case 63 communicates to the outside of the cartridge 7 through the atmosphere communication hole 113. Therefore, the atmosphere is provided in the space between the sheet member 107 and the second case 63.

The space between the sheet member 107 and the second case 63 is called as an atmospheric chamber 115. The atmosphere communication hole 113 communicates to the atmospheric chamber 115. In the present embodiment, the communication hole 91 communicates to the atmospheric chamber 115. That is, in the present embodiment, the space surrounded by the surrounding wall 86 communicates to the atmosphere communication hole 113 through the atmospheric chamber 115 from the communication hole 91.

When the ink in the liquid containing section 109 is reduced, the valve unit 101 becomes the open state so that the air hole 114 is opened. Therefore, the outside atmosphere of the cartridge 7 flows inside the liquid containing section 109 through the atmosphere communication hole 113, the atmospheric chamber 115 and the air hole 114. When the pressure reduction of the liquid containing section 109 is reduced by flowing the atmosphere to the liquid containing section 109, the valve unit 101 becomes the close state. Therefore, the air hole 114 is sealed by the valve unit 101. With such operations, the pressure of the liquid containing section 109 maintains within the appropriate pressure range for supplying the ink to the print head 19.

Figure 8:
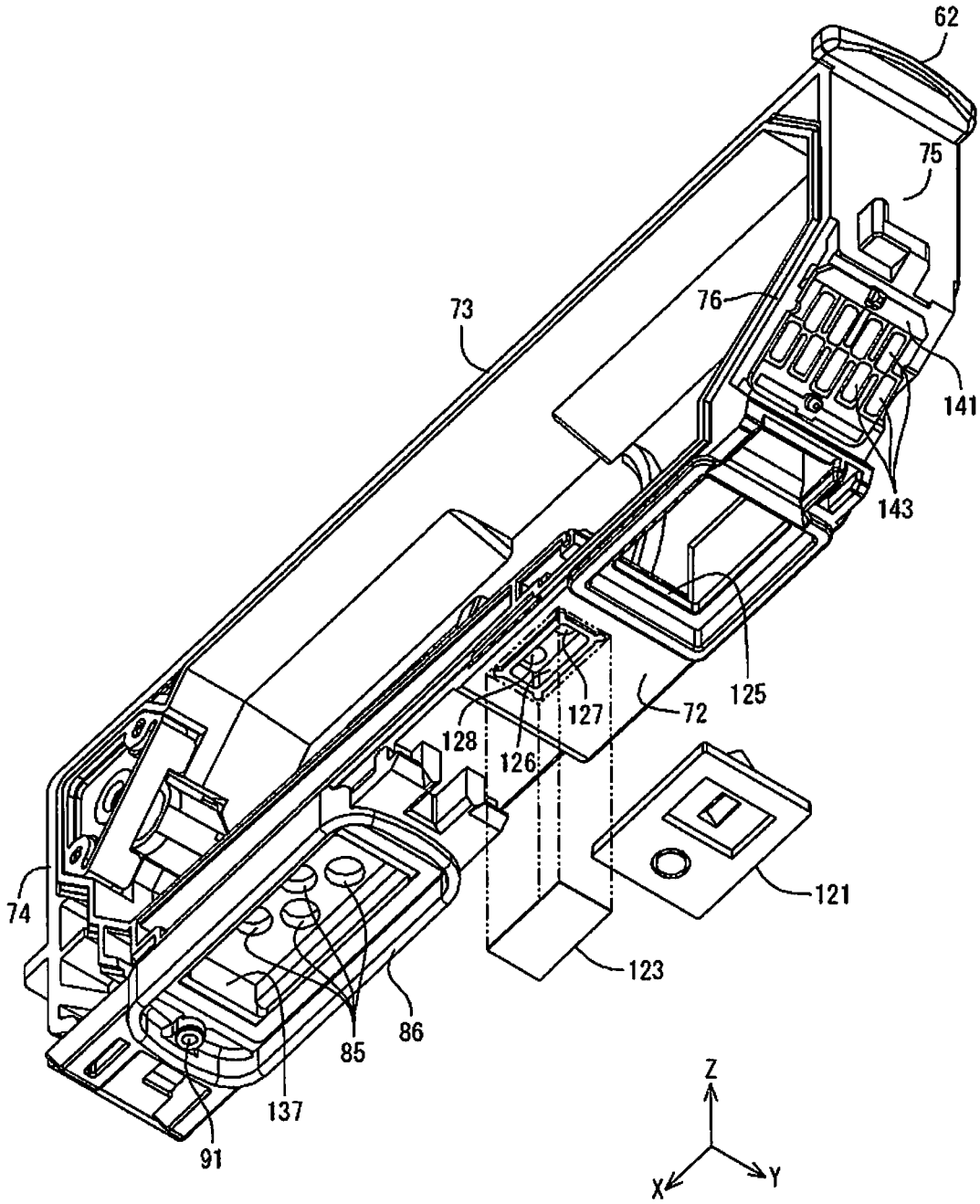
FIG. 8 is a perspective view showing the first case according to the present embodiment.
Figure 9:
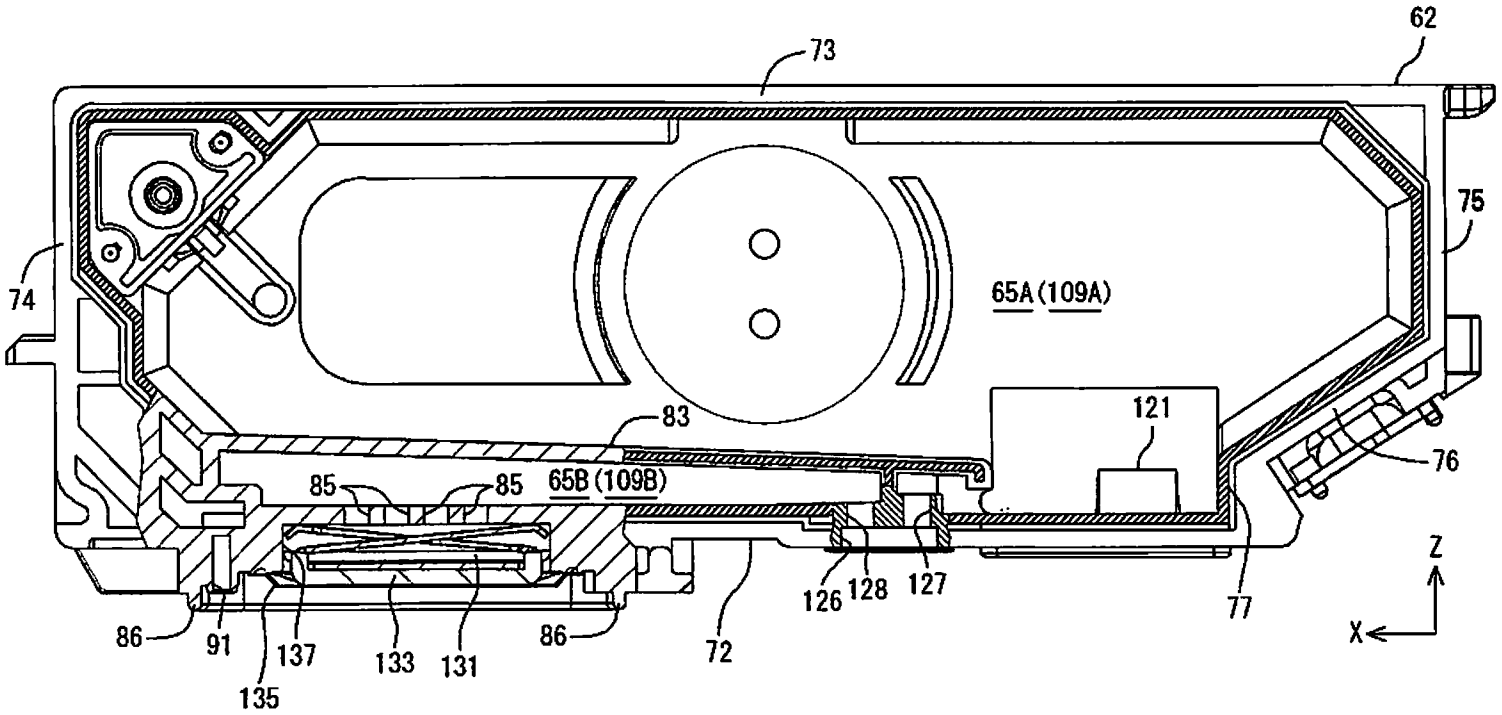
FIG. 9 is an explanatory diagram for a structure of the inside of the first case according to the present embodiment.

Further, as shown in FIG. 5, the cartridge 7 is provided with a prism 121 and a sheet member 123. Here, an opening section 125 is provided in the second wall 72 of the first case 62 as shown in FIG. 8. The inside of the first case 62 and the outside of the first case 62 communicate through the opening section 125. The prism 121 is provided in the position that overlaps with the opening section 125, and it has a size that covers the opening section 125. The opening section 125 is sealed from the outside of the first case 62 by the prism 121. As shown in FIG. 9, the prism 121 projects from the outside of the first case 62 to the inside of the first case 62 through the opening section 125. In the present embodiment, since the opening section 125 is sealed by the prism 121, the leakage of the ink, which is in the liquid containing section 109, from the opening section 125 can be suppressed. Thus, the prism 121 configures a part of the inner surface 67 of the liquid containing section 109. Therefore, the prism 121 can be considered as a part of the first case 62.

The prism 121 functions as a liquid detection section for optically detecting existence or non-existence of the ink. The prism 121 is provided with a material having light permeability and is formed by a synthetic resin, for example, polypropylene, etc. It is acceptable if the material configuring the prism 121 has appropriate light permeability so that it does not have to be transparent. For example, the following method can be used for the detection of the existence or non-existence of the ink in the liquid containing section 109. An optical sensor, which is provided with a light emitting element and a light receiving element, is provided in the printer 5. The light is emitted toward the prism 121 from the light emitting element. When the ink exists around the prism 121, the light transmits through the prism 121 and directions to the inside of the liquid containing section 109. On the other hand, when the ink does not exist around the prism 121, the light emitted from the light emitting element is reflected by two reflecting surfaces of the prism 121 and reaches to the light receiving element. The printer 5 determines the existence or non-existence of the ink in the liquid containing section 109 based on whether the light reaches to the light receiving element. The existence or non-existence of the ink is determined by the control section 21.

Further, in the second wall 72 of the first case 62, as shown in FIG. 8, a recessed section 126, which becomes a concave toward the inside of the recessed section 65 from the outside of the second wall 72, is provided between the opening section 125 and the supply holes 85 in the X-axis direction. A communication hole 127 and a communication hole 128 which communicate from the inside of the recessed section 126 to the inside of the recessed section 65 are provided in the second wall 72 of the inside of the recessed section 126. The sheet member 123 is provided in the position that overlaps with the recessed section 126, and it has a size that covers the recessed section 126. The sheet member 123 seals the recessed section 126 from the outside of the first case 62. In the present embodiment, since the recessed section 126 is sealed by the sheet member 123, the leakage of the ink, which is in the liquid containing section 109, from the recessed section 126 can be suppressed. Thus, the sheet member 123 can be considered as a part of the inner surface 67 of the liquid containing section 109. Therefore, the sheet member 123 can be considered as a part of the first case 62.

As shown in FIG. 9, the communication hole 127 communicates from the inside of the first recessed section 65A to the inside of the recessed section 126. The communication hole 128 communicates from the inside of the recessed section 126 to the inside of the second recessed section 65B. That is, the first recessed section 65A and the second recessed section 65B are communicated each other through the communication hole 127, the recessed section 126, and the communication hole 128. Therefore, the first liquid containing section 109A and the second liquid containing section 109B are communicated through the communication hole 127, the recessed section 126, and the communication hole 128. FIG. 9 shows a cross-section when the communication hole 127 and the communication hole 128 are cut in the XY plane surface.

Further, as shown in FIG. 5, the cartridge 7 is provided with a plate spring 131, a foam 133, and a filter 135. Here, as shown in FIG. 8, in the first case 62, a recessed section 137, which becomes a concave toward the inside of the recessed section 65 from the outside of the second wall 72, is provided in the region surrounded by the surrounding wall 86 and in the region that overlaps with the supply holes 85. Also, as shown in FIG. 9, the plate spring 131 and the foam 133 are stored in the recessed section 137. Also, the filter 135 is provided in the region surrounded by the surrounding wall 86, and it covers the recessed section 137 from the outside of the second wall 72. As the filter 135, for example, a film material provided with a through-hole by the press-processing, etc., an asymmetric membrane such as MMM film made by PALL Corporation, and a symmetric membrane such as, for example, a woven fabric, etc. can be employed.

In the opposite side from the recessed section 65 side of the sixth wall 76, that is, the outside of the sixth wall 76, as shown in FIG. 8, a circuit substrate 141 is provided. The circuit substrate 141 extends along the sixth wall 76. Therefore, the circuit substrate 141 is inclined with respect to the second wall 72 and the fifth wall 75, respectively. The circuit substrate 141 is inclined in the direction approaching to the fourth wall 74 as it approaches from the third wall 73 side to the second wall 72 side. In the surface of the opposite side from the sixth wall 76 side of the circuit substrate 141, a plurality of terminals 143 that contact to the contact mechanism 27 (FIG. 3) of the holder 25 are provided. In the sixth wall 76 side of the circuit substrate 141, a memory device (not shown) such as a non-volatile memory is provided. A plurality of terminals 143 are electrically connected to this memory device.

In the state that the cartridge 7 is mounted in the holder 25, the plurality of terminals 143 are electrically connected to the contact mechanism 27 as shown in FIG. 3. The contact mechanism 27 is electrically connected to the control section 21 through the flexible cable 23 (FIG. 1). Also, it is possible to transmit various information between the control section 21 and the memory device of the cartridge 7 by electrically connecting between the contact mechanism 27 and the memory device of the cartridge 7 through the circuit substrate 141.

Figure 10:
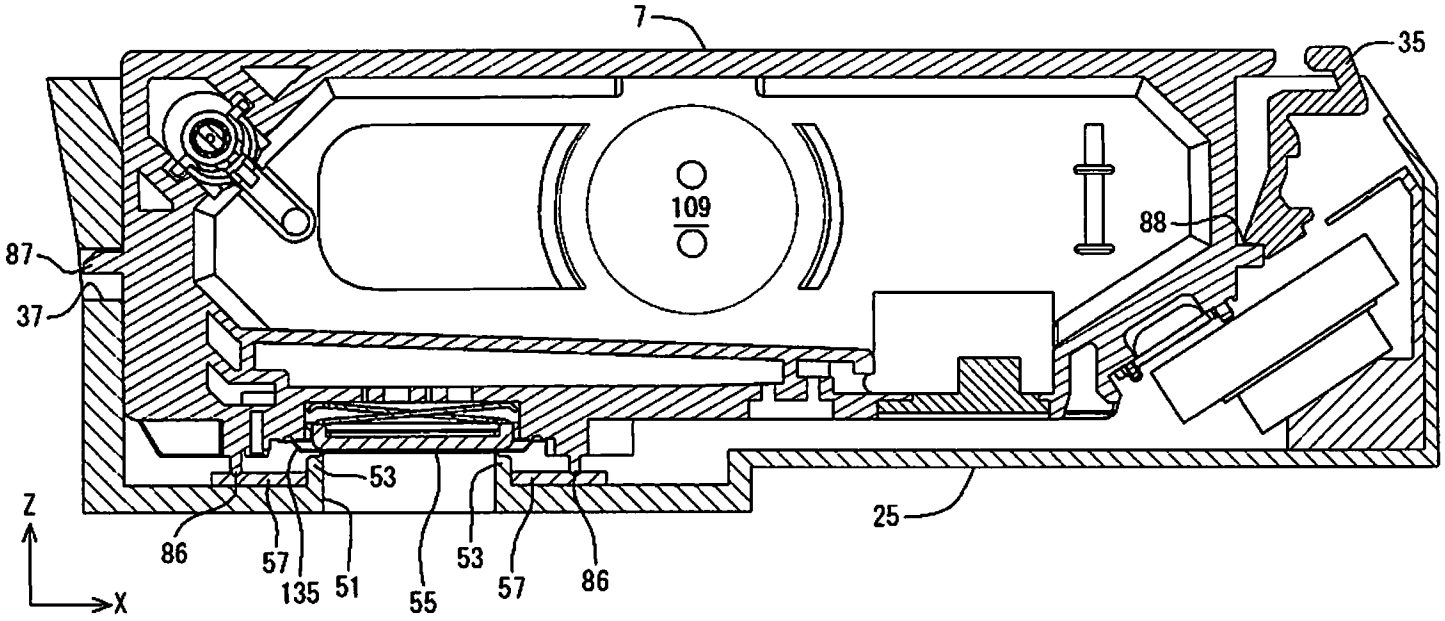
FIG. 10 is a diagram showing a state that the cartridge according to the present embodiment is mounted on the holder.

As shown in FIG. 10, the cartridge 7 having the aforementioned configuration is fixed in the position by the lever 35 in the state that it is mounted in the holder 25. When the cartridge 7 is mounted in the holder 25, the surrounding wall 86 contacts to the packing 57, and the cylindrical section 53 is inserted into the region surrounded by the surrounding wall 86. That is, the surrounding wall 86 surrounds the flow channel 51 from the outside than the cylindrical section 53. Also, in the region surrounded by the surrounding wall 86, the filter 135 contacts to the filter 55. Therefore, the ink in the liquid containing section 109 can be supplied to the flow channel 51 from the filter 55 via the foam 133 (FIG. 9) and the filter 135 (FIG. 10) from the supply holes 85 (FIG. 9).

At this point, the surrounding wall 86 contacts to the packing 57 in the state that it surrounds the flow channel 51 from the outside than the cylindrical section 53. Therefore, the airtightness of the space surrounded by the surrounding wall 86 and the packing 57 is enhanced. Accordingly, when the ink is supplied from the cartridge 7 to the flow channel 51, the ink leaked to the outside of the region surrounded by the cylindrical section 53 is blocked by the packing 57 and the surrounding wall 86.

Figure 11A:
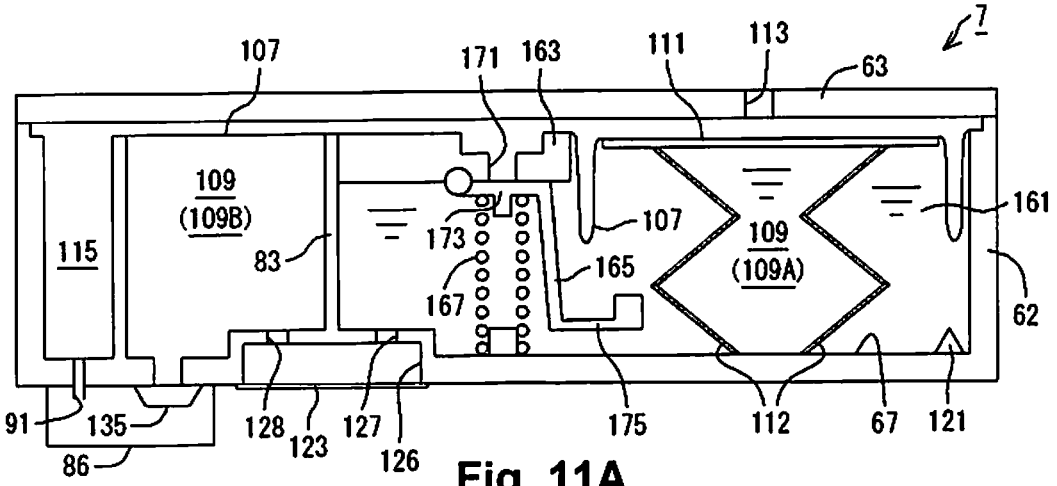
FIGS. 11A, 11B, and 11C are cross-sectional views schematically showing the inner section of the cartridge according to the present embodiment.

The flow of the ink in the cartridge 7 of the present embodiment and the flow of the atmosphere will be described. In the cartridge 7, as shown in FIG. 11A, the ink 161 is stored in the liquid containing section 109 partitioned by the first case 62 and the sheet member 107. The liquid containing section 109 is partitioned into the first liquid containing section 109A and the second liquid containing section 109B by the partition wall 83. The valve unit 101 (FIG. 5) is provided in the liquid containing section 109. The valve unit 101 includes a cover valve 163, a lever valve 165, and a spring member 167 as shown in FIG. 11A.

In the cover valve 163, an atmosphere introduction port 171 is provided. The atmosphere introduction port 171 penetrates through the cover valve 163. In the cartridge 7, the atmosphere introduction port 171 functions as a communication passage that communications between the inner part of the first liquid containing section 109A and the atmospheric chamber 115 in the outer part of the liquid containing section 109. The lever valve 165 is provided in the opposite side from the second case 63 side of the cover valve 163. The lever valve 165 includes a valve section 173 and a lever section 175. The valve section 173 is overlapped with the atmosphere introduction port 171 of the cover valve 163. The lever section 175 extends from the valve section 173 and within the region between the pressure receiving section 111 and the inner surface 67 of the first wall 71. The spring member 167 is provided in the opposite side from the cover valve 163 side of the lever valve 165. The spring member 167 urges the valve section 173 of the lever valve 165 toward the cover valve 163 side. Therefore, the atmosphere introduction port 171 of the cover valve 163 is sealed by the valve section 173. Hereinafter, in the state that the atmosphere introduction port 171 is sealed by the valve section 173, it expresses as the close state of the valve unit 101.

Figure 11B:
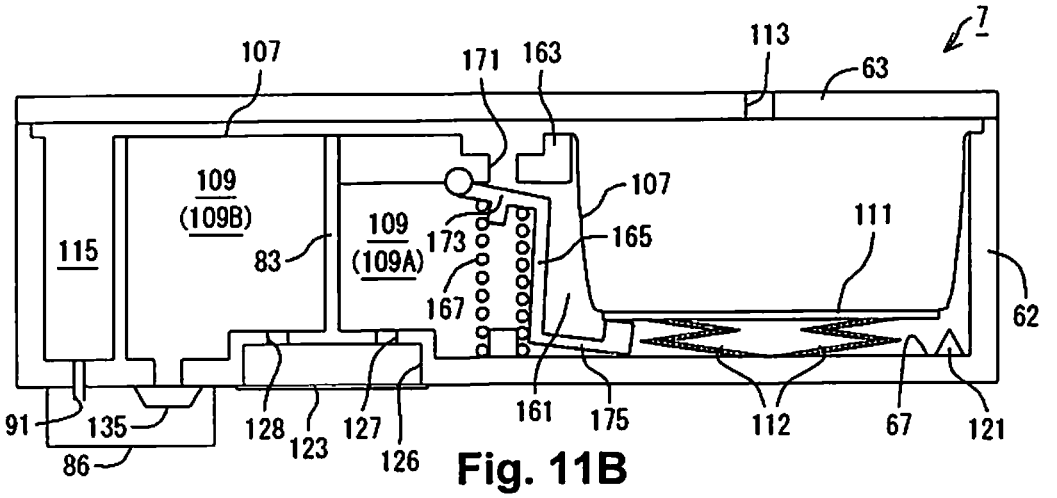

When the ink 161 in the liquid containing section 109 is consumed, as shown in FIG. 11B, the pressure receiving section 111 is displaced toward the inner surface 67 side of the first wall 71. When the pressure receiving section 111 is displaced toward the inner surface 67 side of the first wall 71, the pressure receiving section 111 presses the lever section 175 toward the inner surface 67 side of the first wall 71. Thus, the posture of the valve section 173 is changed, and a gap between the valve section 173 and the cover valve 163 is generated. Therefore, the atmosphere introduction port 171 and the first liquid containing section 109A are communicated. Hereinafter, in the state that the atmosphere introduction port 171 and the liquid containing section 109 are communicated by generating the gap between the valve section 173 and the cover valve 163, it expresses as the open state of the valve unit 101. When the valve unit 101 becomes the open state, the atmosphere of the atmospheric chamber 115 in the outside of the liquid containing section 109 is flowed into the inner part of the first liquid containing section 109A through the atmosphere introduction port 171.

Figure 11C:
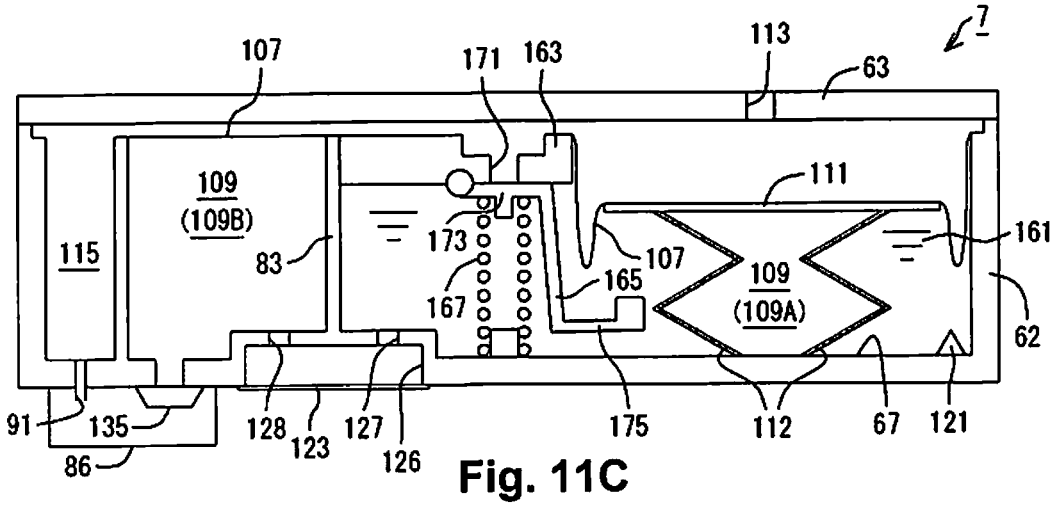

As described above, the pressure receiving section 111 is urged toward the second case 63 side by the urging section 112. Therefore, when the atmosphere is flowed to the inner part of the first liquid containing section 109A through the atmosphere introduction port 171, the pressure receiving section 111 is displaced toward the second case 63 side by the urging-force from the urging section 112 as shown in FIG. 11C. That is, by flowing the atmosphere into the inner part of the first liquid containing section 109A through the atmosphere introduction port 171, the volume of the first liquid containing section 109A increases in comparison with the condition shown in FIG. 11B. Therefore, the negative pressure in the liquid containing section 109, which is in the low pressure (negative) state than the atmospheric pressure, is reduced (it becomes closer to the atmospheric pressure). When a certain level of the atmosphere is introduced into the first liquid containing section 109A, the pressure receiving section 111 is separated from the lever section 175. Therefore, the valve section 173 seals the atmosphere introduction port 171. That is, the valve unit 101 becomes the close state. Thus, it is possible to maintain the pressure in the liquid containing section 109 within the appropriate pressure range by which the lever valve 165 temporally becomes the open state when the negative pressure in the liquid containing section 109 becomes larger in accordance with the consumption of the ink 161 of the liquid containing section 109.

The detail of the urging plate 104 will be described in each example of the urging plate 104. Hereinafter, different letters, signs, numbers for the symbols of the urging plate 104 are shown in each example to identify the urging plate 104 in each example.

Example 1

Figure 12:
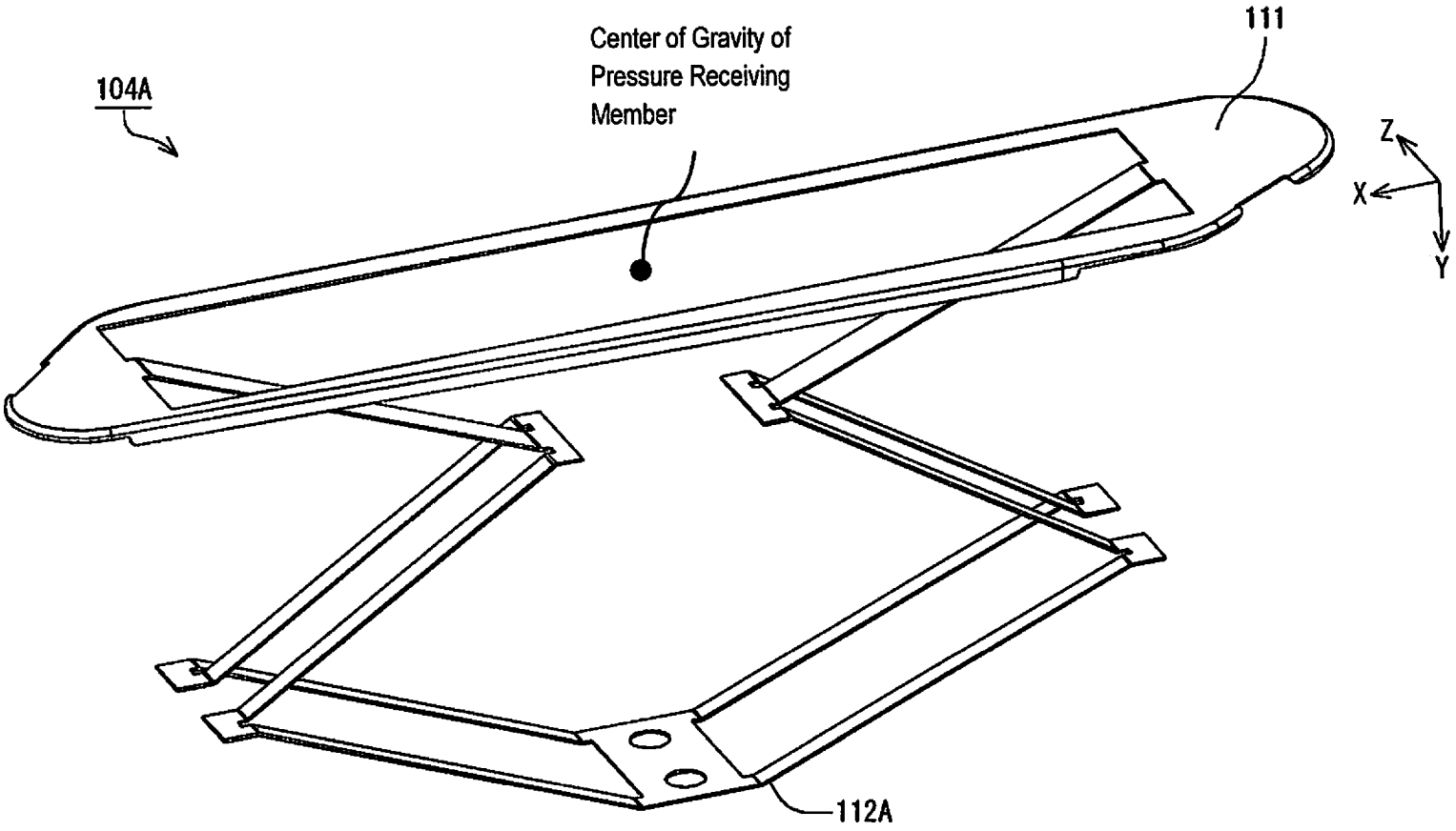
FIG. 12 is a perspective view showing an urging plate according to Example 1.
Figure 13:
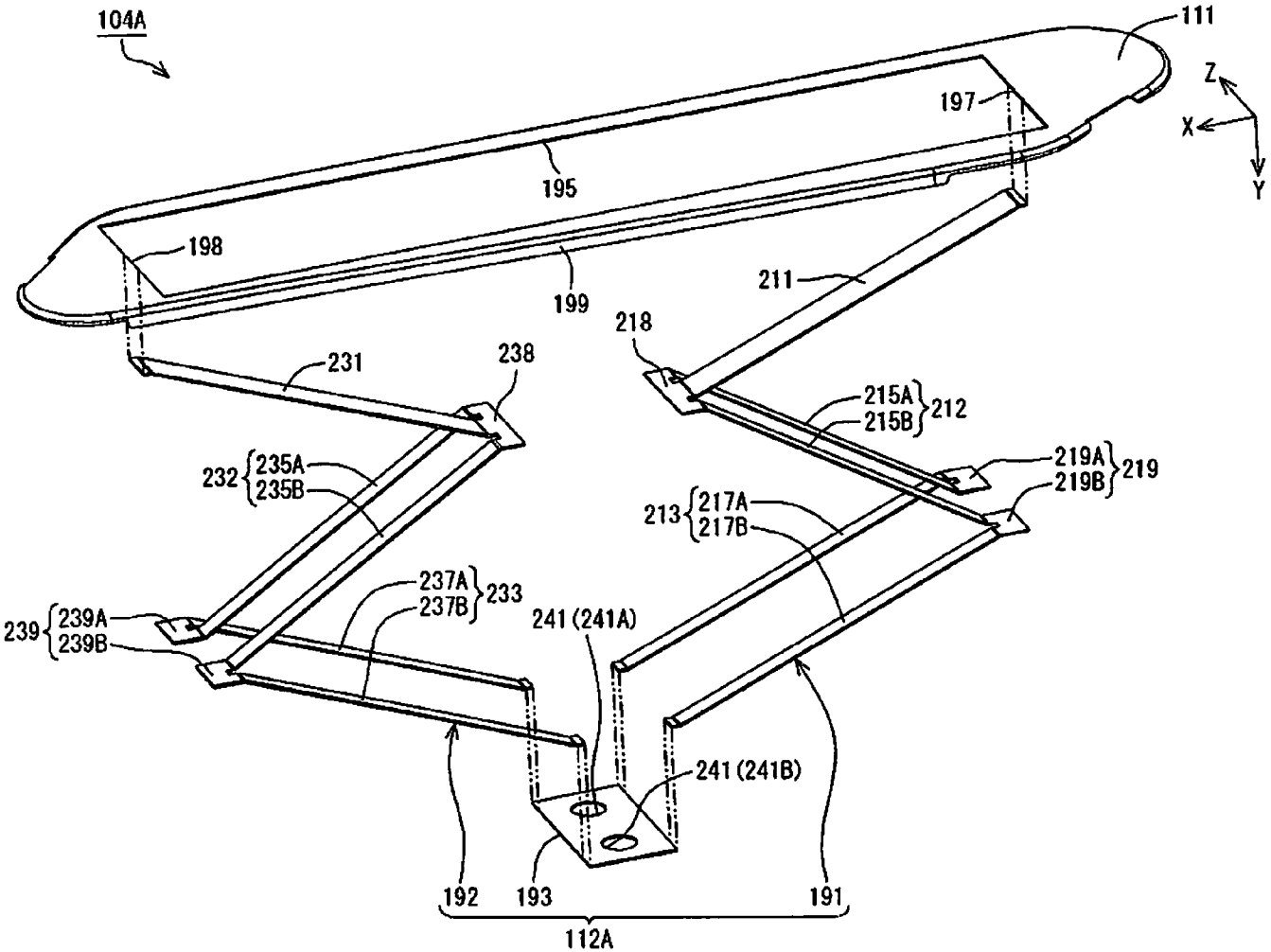
FIG. 13 is an exploded view when the urging plate according to Example 1 is cut into a plurality of parts.

As shown in FIG. 12, an urging plate 104A in Example 1 is provided with the pressure receiving section 111 and an urging section 112A. As shown in FIG. 13 that is an exploded view when the urging plate 104A is cut into a plurality of parts, it can be divided into a first urging member 191, a second urging member 192, and a joint member 193. Here, the urging plate 104A is formed by integrally forming the pressure receiving section 111 and the urging section 112A from one plate material. However, to present a simple configuration, FIG. 13 shows the exploded view when the urging plate 104A is cut into the plurality of parts.

The pressure receiving section 111 is formed in a plate shape and has an opening section 195. The opening section 195 penetrates through the pressure receiving section 111. The pressure receiving section 111 has an annular shape except a joint section 197 that is the part connecting with the first urging member 191 and a joint section 198 that is the part connecting with the second urging member 192. The first urging member 191, the second urging member 192, and the joint member 193 are stored in the region that is the inside of the opening section 195 when the pressure receiving section 111 is viewed in a plane view.

In at least one part of the circumferential edge of the pressure receiving section 111, a bending process is applied so as to bend the edge in a direction to become a convex toward the urging section 112A side. By this bending process, a bent edge section 199 is provided in at least one part of the circumferential edge of the pressure receiving section 111. By this bent edge section 199, rigidity of the pressure receiving section 111 is enhanced. Specifically, in the pressure receiving section 111 that easily lowers rigidity by the opening section 195, the rigidity of the pressure receiving section 111 is preferably enhanced by the bent edge section 199.

The direction of the bent edge section 199 can be employed in the direction to become a convex toward the opposite side from the urging section 112A side. Even it is in this direction, the rigidity of the pressure receiving section 111 can be enhanced. However, the opposite side from the urging section 112A side of the pressure receiving section 111 is the side contacting to the sheet member 107. Therefore, it is preferable that the direction of the bent edge section 199 is in the direction to become a convex toward the urging section 112A side in view of avoiding the cause of the damage to the sheet member 107 by the bent edge section 199.

The first urging member 191 is provided with a first leg 211, a second leg 212, and a third leg 213. The second leg 212 is provided with a leg 215A and a leg 215B. The leg 215A and the leg 215B are aligned in the direction intersecting with the direction of which the first leg 211 extends when the pressure receiving section 111 is viewed in a plane view. Further, the third leg 213 is provided with a leg 217A and a leg 217B. The leg 217A and the leg 217B are aligned in the direction intersecting with the direction of which the first leg 211 extends when the pressure receiving section 111 is viewed in a plane view.

The first leg 211 and the second leg 212 are connected to each other through the joint section 218. The second leg 212 and the third leg 213 are connected to each other through the joint section 219. The second leg 212 includes two of the leg 215A and the leg 215B so that the joint section 219 includes the joint section 219A and the joint section 219B. Also, the leg 215A and the leg 217A are connected to each other through the joint section 219A. In the same manner, the leg 215B and the leg 217B are connected to each other through the joint section 219B. The first leg 211, the second leg 212, and the third leg 213 are respectively inclined with respect to the pressure receiving section 111. The first leg 211, the second leg 212, the third leg 213 are respectively inclined in the direction approaching from the pressure receiving section 111 side to the first wall 71 (FIG. 5) of the first case 62.

When the pressure receiving section 111 is viewed in the plane view, the first leg 211 extends in the direction from the joint section 197 to the center side of the opening section 195, that is, the edge side of the opening section 195 to the center side of the opening section 195. When the pressure receiving section 111 is viewed in the plane view, the second leg 212 extends in the direction from the center side of the opening section 195 to the edge side of the opening section 195. Thus, the second leg 212 is inclined in the direction opposing to the direction of the inclination of the first leg 211. Further, when the pressure receiving section 111 is viewed in the plane view, the third leg 213 extends in the direction from the edge side of the opening section 195 to the center side of the opening section 195. Therefore, the third leg 213 is inclined in the same direction of the inclination of the first leg 211.

The second urging member 192 is provided with a first leg 231, a second leg 232, and a third leg 233. The second leg 232 is provided with a leg 235A and a leg 235B. When the pressure receiving section 111 is viewed in the plane view, the leg 235A and the leg 235B are aligned in the direction intersecting with the direction of which the first leg 231 extends. Also, the third leg 233 is provided with a leg 237A and a leg 237B. When the pressure receiving section 111 is viewed in the plane view, the leg 237A and the leg 237B are aligned in the direction intersecting with the direction of which the first leg 231 extends.

The first leg 231 and the second leg 232 are connected to each other through the joint section 238. The second leg 232 and the third leg 233 are connected to each other through the joint section 239. The second leg 232 includes two of the leg 235A and the leg 235B so that the joint section 239 includes a joint section 239A and a joint section 239B. The leg 235A and the leg 237A are connected to each other through the joint section 239A. In the same manner, the leg 235B and the leg 237B are connected to each other through the joint section 239B. The first leg 231, the second leg 232, and the third leg 233 are respectively inclined with respect to the pressure receiving section 111. The first leg 231, the second leg 232, and the third leg 233 are respectively inclined in the direction approaching to the first wall 71 (FIG. 5) of the first case 62 from the pressure receiving section 111 side.

When the pressure receiving section 111 is viewed in the plane view, the first leg 231 extends in the direction from the joint section 198 to the center side of the opening section 195, that is, in the direction from the edge side of the opening section 195 to the center side of the opening section 195. When the pressure receiving section 111 is viewed in the plane view, the second leg 232 extends in the direction from the center side of the opening section 195 to the edge side of the opening section 195. Therefore, the second leg 232 is inclined in the direction opposing to the direction of the inclination of the first leg 231. Also, when the pressure receiving section 111 is viewed in the plane view, the third leg 233 extends in the direction from the edge side of the opening section 195 to the center side of the opening section 195. Therefore, the third leg 233 is inclined in the same direction of the direction of the inclination of the first leg 231.

The joint section 197 and the joint section 198 are positioned in the opposite side to each other through the central part of the opening section 195. Therefore, the first leg 211 extends in the direction from the joint section 197 to the second urging member 192 side. In the same manner, the first leg 231 extends in the direction from the joint section 198 to the first urging member 191 side. Therefore, the direction of the inclination of the first leg 211 and the direction of the inclination of the first leg 231 are opposite to each other. In the same manner, the direction of the inclination of the second leg 212 and the direction of the inclination of the second leg 232 are opposite to each other. The direction of the inclination of the third leg 213 and the direction of the inclination of the third leg 233 are opposite to each other.

The third leg 213 and the third leg 233 are connected to each other through the joint member 193. That is, the first urging member 191 and the second urging member 192 are connected to each other through the joint member 193. In the urging plate 104A, the first urging member 191 and the second urging member 192 are the symmetric shape to each other through the joint member 193. Further, in the urging plate 104A, when the pressure receiving section 111 is viewed in the plane view, the position of the center of gravity of the pressure receiving section 111 is overlapped with the joint member 193. Therefore, in the urging plate 104A, when the pressure receiving section 111 is viewed in the plane view, the center of gravity of the pressure receiving section 111 is positioned between the first urging member 191 and the second urging member 192.

In terms of design, the spring constant of the first leg 211 and the spring constant of the first leg 231 are equally set to each other. Also, the spring constant of the joint section 218 and the spring constant of the joint section 238 are equally set to each other. In the same manner, the spring constant of the second leg 212 and the spring constant of the second leg 232 are equally set to each other, and the spring constant of the joint section 219 and the spring constant of the joint section 239 are equally set to each other, and the spring constant of the third leg 213 and the spring constant of the third leg 233 are equally set to each other. With the aforementioned setting, the spring constant of the first urging member 191 and the spring constant of the second urging member 192 can be equally set to each other.

Figure 14:
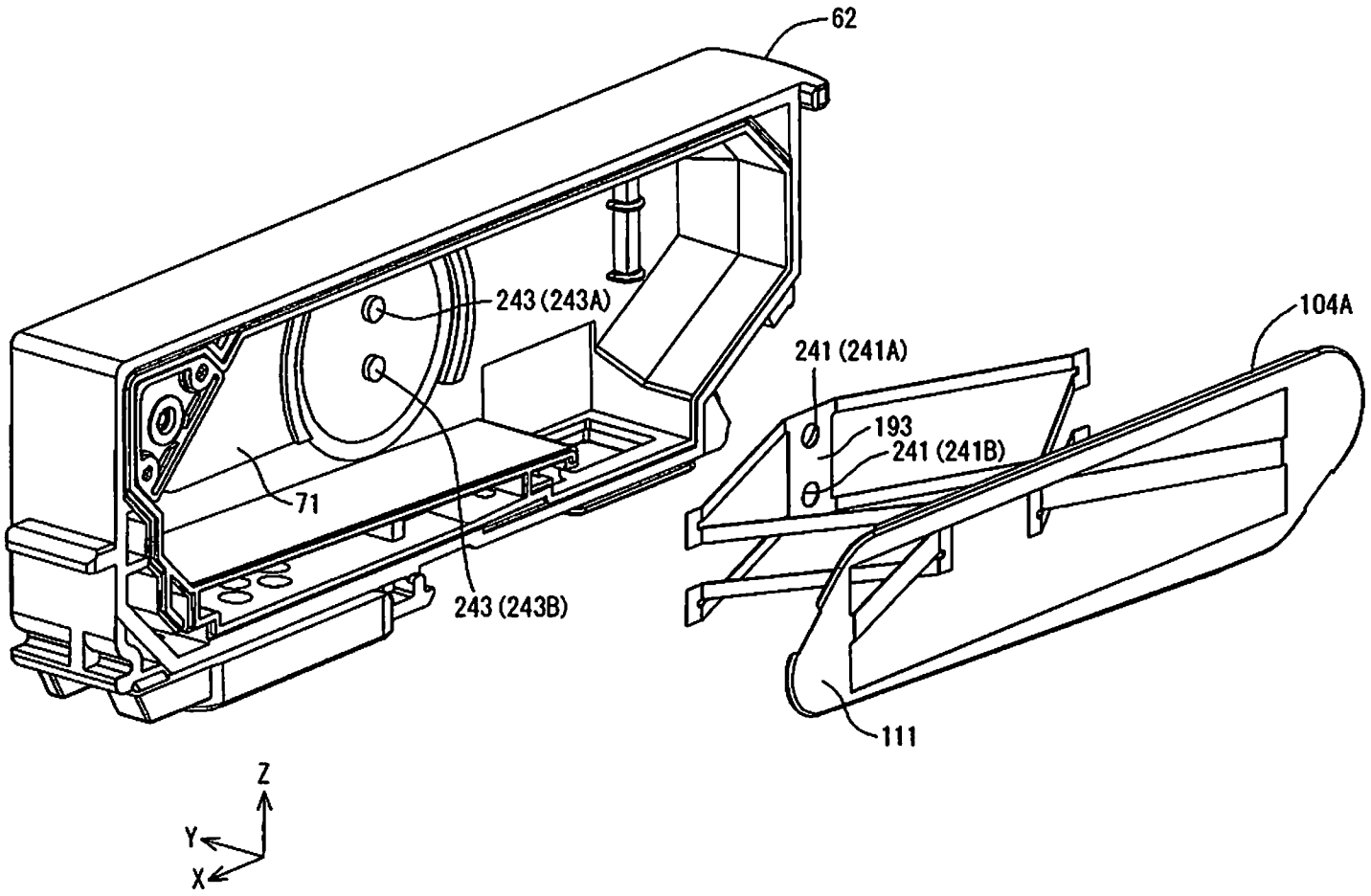
FIG. 14 is a perspective view showing the urging plate and the first case according to Example 1.

The joint member 193 is formed in a plate shape, and two mounting holes 241 are provided. Hereinafter, when the two mounting holes 241 are distinguished, the two mounting holes 241 are respectively shown as a mounting hole 241A and a mounting hole 241B. The two mounting holes 241 are used to connect between the urging plate 104A and the first case 62. As shown in FIG. 14, two convex sections 243 corresponding to the two mounting holes 241 are provided on the first wall 71 of the first case 62. The two convex sections 243 project toward the −Y-axis direction side from the first wall 71, that is, the second case 63 (FIG. 5) side from the first wall 71. Hereinafter, when the two convex sections 243 are distinguished, two convex sections 243 are respectively shown as a convex section 243A and a convex section 243B.

Figure 15:
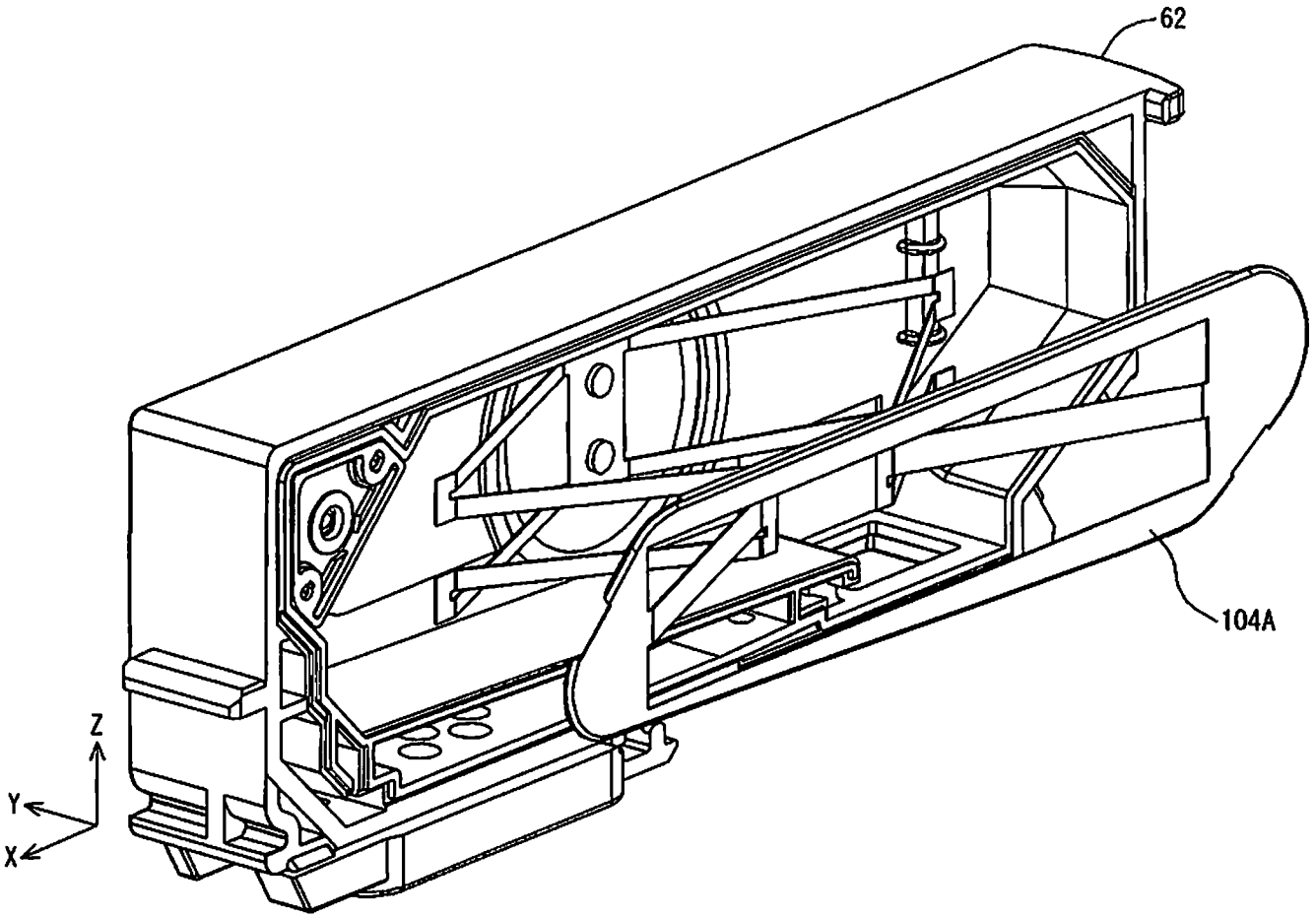
FIG. 15 is a perspective view showing the urging plate and the first case according to Example 1.

The convex section 243A corresponds to the mounting hole 241A, and the convex section 243B corresponds to the mounting hole 241B. The convex section 243A and the mounting hole 241A are configured to enable to fit to each other. In the same manner, the convex section 243B and the mounting hole 241B are configured to enable to fit to each other. The projection amounts of the two convex sections 243 from the first wall 71 are respectively larger than the thickness of the joint member 193. Thus, when the convex section 243 is inserted to the mounting hole 241, the convex section 243 penetrates through the joint member 193 and projects from the joint member 193 to the pressure receiving section 111 side. The joint member 193 is connected to the first case 62 by performing the caulking-processing to the respective convex section 243A and convex section 243B in the state that the convex section 243A is inserted into the mounting hole 241A and the convex section 243B is inserted into the mounting hole 241B. Therefore, as shown in FIG. 15, the urging plate 104A is connected to the first case 62.

Figure 16:
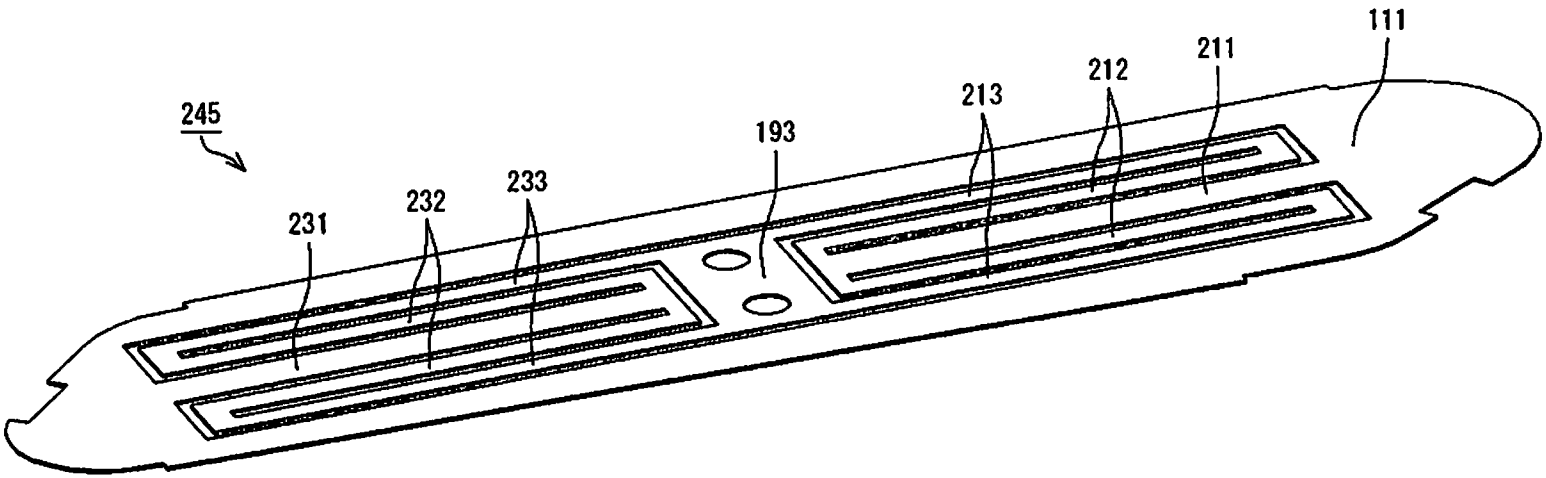
FIG. 16 is a perspective view showing the outer shape of the urging plate according to Example 1.

The manufacturing method of the urging plate 104A will be described. The manufacturing method of the urging plate 104A includes an outer shape forming step, a bent edge step, a leg bending step, and a heat treatment step. In the outer shape forming step, as shown in FIG. 16, an outer shape 245 that becomes an original of the urging plate 104A is formed. In this outer shape forming step, the outer shape 245 is formed by performing a punching process (stamping) to a plate material. In the outer shape 245, the pressure receiving section 111, the first leg 211, the second leg 212, the third leg 213, and the joint member 193 are mutually positioned on approximately the same plane. Further, the pressure receiving section 111, the first leg 231, the second leg 232, the third leg 233, and the joint member 193 are mutually positioned on approximately the same plane.

Figure 17:
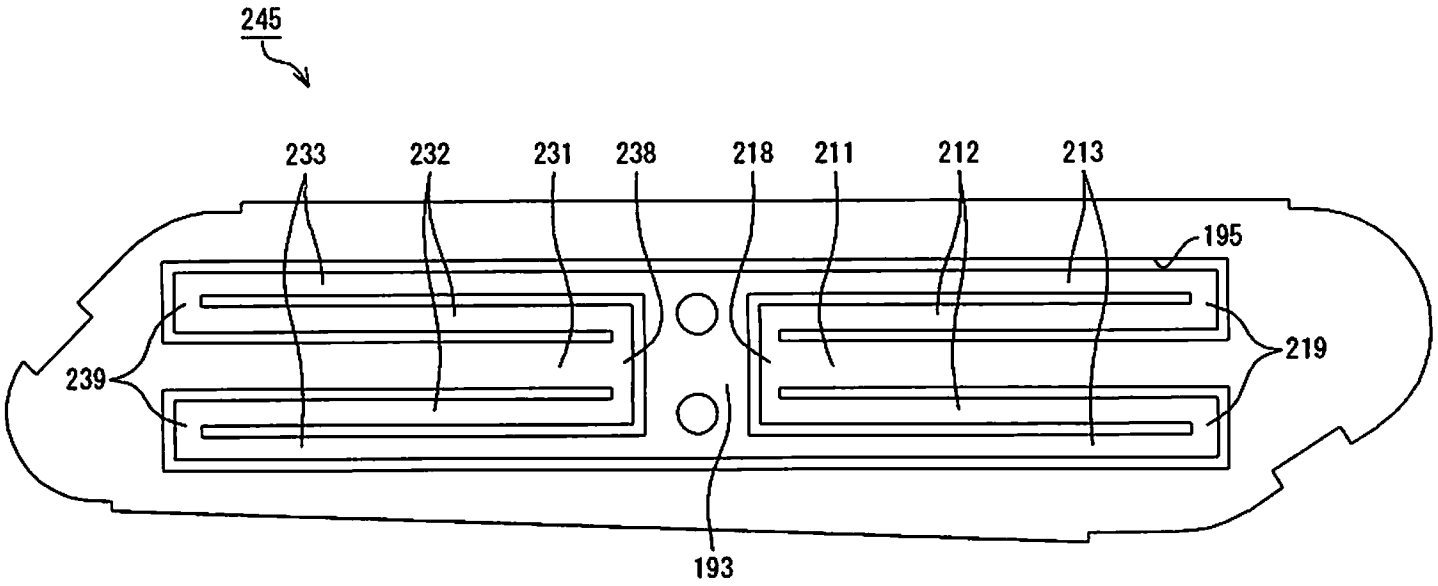
FIG. 17 is a plane view showing the outer shape of the urging plate according to Example 1.

Further, in the outer shape 245, as shown in FIG. 17, the first leg 211, the second leg 212, the third leg 213, the joint section 218, the joint section 219, and the joint member 193 are stored inside the opening section 195. In the same manner, in the outer shape 245, the first leg 231, the second leg 232, the third leg 233, the joint section 238, and the joint section 239 are stored inside the opening section 195. Therefore, in the urging plate 104A shown in FIG. 12, when the urging section 112A is contracted, the urging section 112A is stored inside the opening section 195.

Further, the first leg 211, the second leg 212, the third leg 213, the joint section 218, the joint section 219, the first leg 231, the second leg 232, the third leg 233, the joint section 238, the joint section 239, and the joint member 193 are provided in the positions that are not overlapped to each other. Therefore, in the urging plate 104A shown in FIG. 12, even when the urging section 112A is contracted, the first leg 211, the second leg 212, the third leg 213, the joint section 218, the joint section 219, the first leg 231, the second leg 232, the third leg 233, the joint section 238, the joint section 239, and the joint member 193 are not mutually overlapped.

In the bent edge step, the bent edge section 199 (FIG. 13) is formed by applying the bending process to a part of the outer edge of the outer shape 245.

In the leg bending step, the inclination with respect to the pressure receiving section 111 of the first leg 211 and the first leg 231, the inclination with respect to the pressure receiving section 111 of the second leg 212 and the second leg 232, and the inclination with respect to the pressure receiving section 111 of the third leg 213 and the third leg 233 are formed. These inclinations can be formed by applying the bending process such as a press-processing, etc. to the outer shape 245. By the leg bending step, the urging section 112A of the urging plate 104A as shown in FIG. 12 is formed.

In the heat treatment step, the urging plate 104A is heated and is then cooled after the bent edge step and the leg bending step. By the heat treatment step, the function of the urging section 112A as a spring can be enhanced. Further, the residual stress in the urging plate 104A can be excluded by the heat treatment step. The heat treatment step can be omitted depending on the degree of the durability that is required for the cartridge 7. Further, it is possible that either one of the bent edge step and the leg bending step can be prior or later.

In the urging plate 104A of Example 1, the two urging members of the first urging member 191 and the second urging member 192 can support the pressure receiving section 111. Therefore, for example, it becomes easy to stabilize the position or the posture of the pressure receiving section 111 in comparison with the case that the pressure receiving section 111 is supported by one urging member. Specifically, in the urging plate 104A, the first urging member 191 and the second urging member 192 are aligned along the direction of which the pressure receiving section 111 extends. The pressure receiving section 111, which has a longitudinal direction, is easily oscillated in the longitudinal direction so that its posture easily gets unstable in the longitudinal direction. On the other hand, in the urging plate 104A, the two urging members are aligned along the longitudinal direction of the pressure receiving section 111 so that the oscillation of the pressure receiving section 111 in the longitudinal direction can be suppressed. Thus, it becomes easy to stabilize the position or the posture of the pressure receiving section 111.

Further, in the urging plate 104A, as described above, when the pressure receiving section 111 is viewed in the plane view, the center of gravity of the pressure receiving section 111 is positioned between the first urging member 191 and the second urging member 192. Therefore, in the urging plate 104A, the pressure receiving section 111 can be supported in two places through the center of gravity of the pressure receiving section 111 so that the pressure receiving section 111 is easily supported in a stable manner. Therefore, it becomes easy to further stabilize the position or the posture of the pressure receiving section 111.

Further, in the urging plate 104A, as described above, the spring constant of the first urging member 191 and the spring constant of the second urging member 192 are equally set to each other. Therefore, the contraction amount of a load per unit is easily set in constant by the first urging member 191 and the second urging member 192. Therefore, the displacement amount of the pressure receiving section 111 by the contraction of the urging section 112A is easily set in constant by the joint section 197 and the joint section 198 so that it becomes easy to further stabilize the position or the posture of the pressure receiving section 111.

Figure 18:
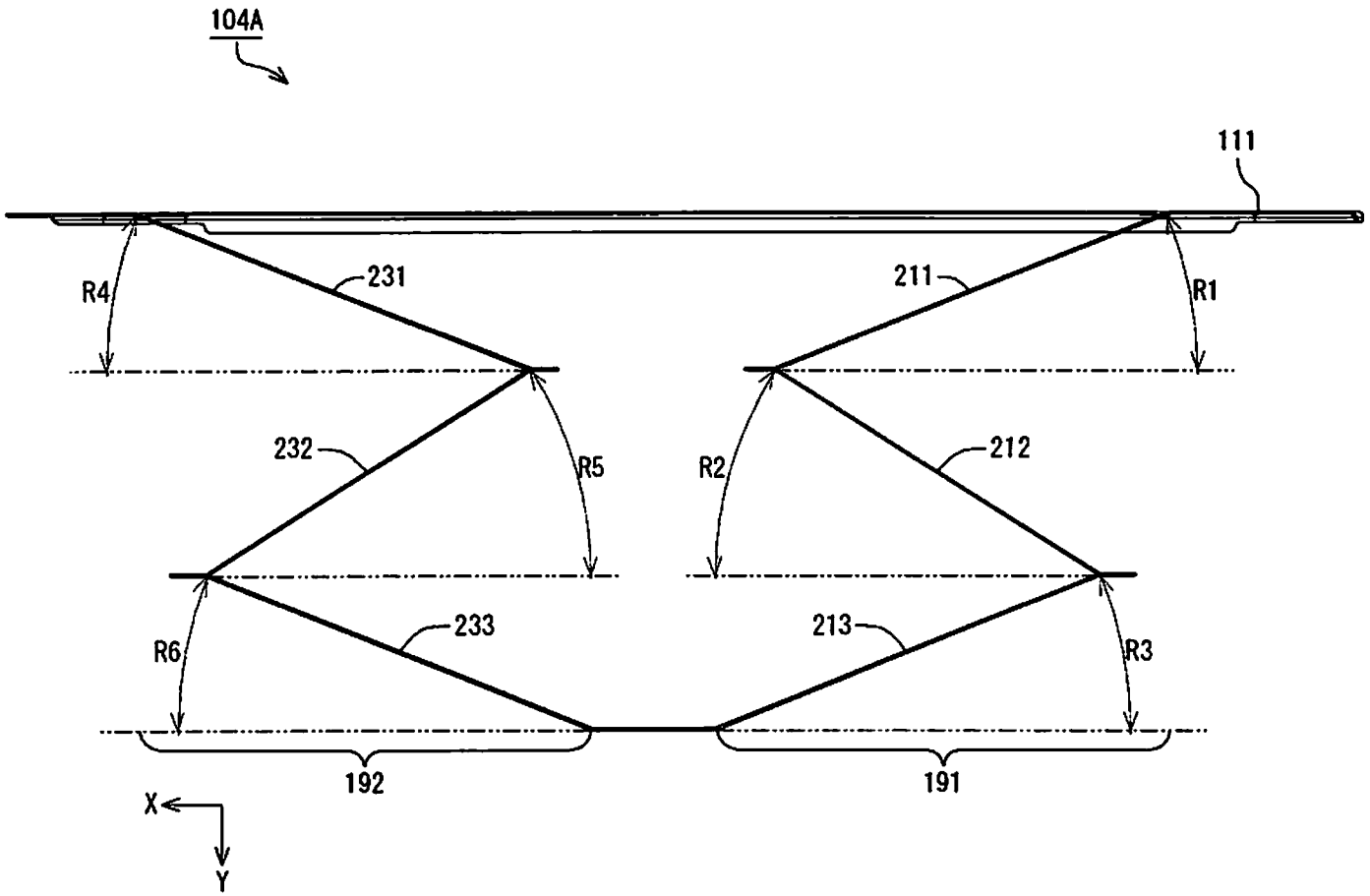
FIG. 18 is a side view showing the urging plate according to Example 1.

Further, in the urging plate 104A, as shown in FIG. 18, the first urging member 191 can be expanded and contracted by the bending and stretching of the first leg 211 in the R1 direction, the bending and stretching of the second leg 212 in the R2 direction, and the bending and stretching of the third leg 213 in the R3 direction. Further, the second urging member 192 can be expanded and contracted by the bending and stretching of the first leg 231 in the R4 direction, the bending and stretching of the second leg 232 in the R5 direction, and the bending and stretching of the third leg 233 in the R6 direction. Therefore, the direction of the expansion and contraction in each of the first urging member 191 and the second urging member 192 is specified by the respective bending and stretching directions of the first leg 211, the second leg 212, and the third leg 213, and as well as, the first leg 231, the second leg 232, and the third leg 233. R1 direction to R6 direction can exist in the same plane (XY plane surface). Therefore, it is easy to specify the respective bending and stretching directions of the first urging member 191 and the second urging member 192 in the direction along the same plane surface (XY plane surface). As a result, the displacement direction of the pressure receiving section 111 is easily limited to the expansion and contraction direction of the first urging member 191 or the second urging member 192 so that the inclination of the pressure receiving section 111 is easily suppressed. Thus, it becomes easy to stabilize the position or the posture of the pressure receiving section 111.

Figure 19:
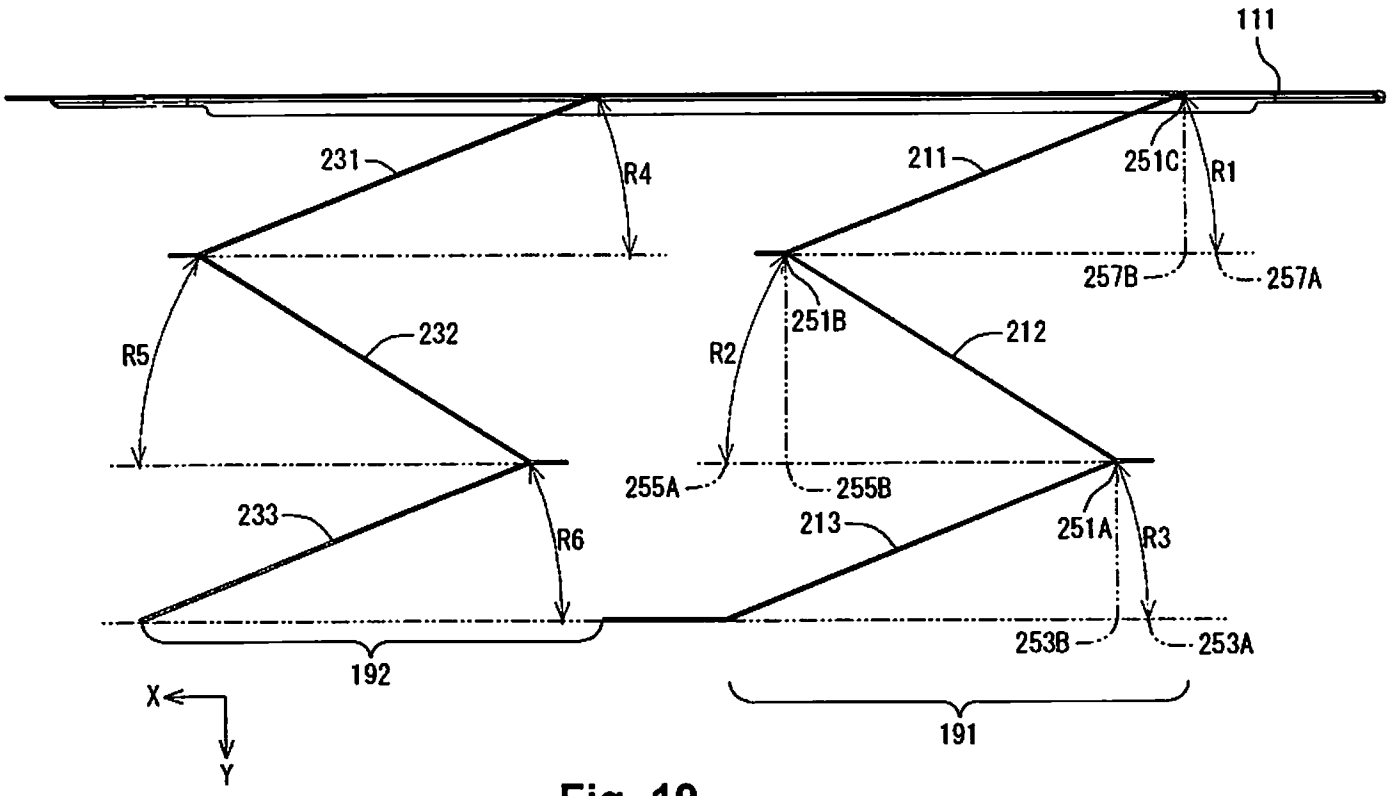
FIG. 19 is a side view showing the urging plate according to Comparative Example 1.

Further, in the urging plate 104A, as described above, the direction of the inclination of the first leg 211 and the direction of the inclination of the first leg 231 are opposite to each other. Here, for example, when the direction of the inclination of the first leg 211 and the direction of the inclination of the first leg 231 are the same direction to each other as shown in FIG. 19 (called as Comparative Example 1), there is a possibility to generate the displacement of the pressure receiving section 111 in the direction (X-axis direction) of which the pressure receiving section 111 extends. In this case, for example, when the first urging member 191 is contracted, the third leg 213 is rotated in the R3 direction, and the second leg 212 is rotated in the R2 direction, and the first leg 211 is rotated in the R1 direction.

At this point, the position 253A of the tip 25 IA of the third leg 213 after the rotation is shifted to the −X-axis direction side than the position 253B in the X-axis direction of the tip 251A before the rotation. Further, the position 255A of the tip 251B of the second leg 212 after the rotation is shifted to the +X-axis direction side than the position 255B in the X-axis direction of the tip 251B before the rotation. In the same manner, the position 257A of the tip 251C of the first leg 211 after the rotation is shifted to the −X-axis direction than the position 257B in the X-axis direction of the tip 251C before the rotation. Such phenomenon is also generated in the second urging member 192. Therefore, when it has an odd number of the legs, in the bending and stretching of the legs, the displacement in the pressure receiving section 111 in the X-axis direction is easily generated. When the direction of the inclination of the first leg 211 and the direction of the inclination of the first leg 231 are the same direction to each other, the displacement in the pressure receiving section 111 in the X-axis direction is easily generated.

For example, when the urging section 112A is contracted by consuming the ink in the liquid containing section 109 as shown in FIGS. 11A-11C, in the case that the displacement in the pressure receiving section 111 in the X-axis direction is generated, the sheet member 107 is easily shifted in the X-axis direction in the course of the contraction of the urging section 112A. That is, when the volume of the liquid containing section 109 is decreased by consuming the ink in the liquid containing section 109, the sheet member 107 approaches to the first wall 71 of the first case 62 while shifting the sheet member 107 to the X-axis direction. Then, when the volume of the liquid containing section 109 is decreased, wrinkles are easily generated in the sheet member 107. When the volume of the liquid containing section 109 is decreased in the state that the wrinkles are generated in the sheet member 107, the ink is easily trapped in the wrinkle portions. That is, the ink is accumulated in the wrinkle portions. When such accumulation is generated, the ink cannot be used to the end so that the ink is easily remained in the cartridge 7.

On the other hand, in the urging plate 104A, the direction of the inclination of the first leg 211 and the direction of the inclination of the first leg 231 are opposite to each other. In this structure, the displacement in the X-axis direction by the bending and stretching of the first urging member 191 and the displacement in the X-axis direction by the bending and stretching of the second urging member 192 are opposite to each other. That is, the displacement in the X-axis direction by the bending and stretching of the first urging member 191 and the displacement in the X-axis direction by the bending and stretching of the second urging member 192 are compensated to each other. Therefore, the displacement of the pressure receiving section 111 in the direction (X-axis direction) that the pressure receiving section 111 extends is easily suppressed. As a result, it becomes easy to further stabilize the position or the posture of the pressure receiving section 111.

Therefore, in the urging plate 104A, when the urging section 112A is contracted by consuming the ink in the liquid containing section 109, the displacement of the pressure receiving section 111 in the X-axis direction is easily suppressed. Thus, the sheet member 107 is hard to be shifted in the X-axis direction in the course of the contraction of the urging section 112A. That is, when the volume of the liquid containing section 109 is decreased by consuming the ink in the liquid containing section 109, the sheet member 107 approaches to the first wall 71 of the first case 62 while the shift of the sheet member 107 in the X-axis direction is suppressed. Accordingly, when the volume of the liquid containing section 109 is decreased, it is hard to generate the winkles in the sheet member 107. Therefore, the ink is easily used to the end so that the remaining amount of the ink in the cartridge 7 can be reduced.

Further, in the urging plate 104A, as described above, the first leg 211 extends in the direction from the joint section 197 to the center side of the opening section 195, that is, in the direction from the edge side of the opening section 195 to the center side of the opening section 195. Also, when the pressure receiving section 111 is viewed in the plane view, the first leg 231 extends in the direction from the joint section 198 to the center side of the opening section 195, that is, in the direction from the edge side of the opening section 195 to the center side of the opening section 195. According to this structure, the distance between the joint section 197 and the joint section 198 can be made longer in comparison with the structure in which the first leg 211 and the first leg 231 respectively extend in the direction from the center side of the opening section 195 to the edge side of the opening section 195. Thus, the pressure receiving section 111 can be supported in two places having a distance to each other so that it is easy to stably support the pressure receiving section 111. Therefore, it becomes easy to further stabilize the position or the posture of the pressure receiving section 111.

Further, in the urging plate 104A, the third leg 213 of the first urging member 191 and the third leg 233 of the second urging member 192 are connected to each other so that variations in the distance between the third leg 213 and the third leg 233 are easily suppressed. Therefore, the variations in the postures of the first urging member 191 and the variations in the postures of the second urging member 192 are easily suppressed. As a result, the variations in the positions or the postures of the pressure receiving section 111 are easily suppressed so that it becomes easy to further stabilize the position or the posture of the pressure receiving section 111.

Further, in the urging plate 104A, the joint member 193 is provided so that the urging plate 104A is easily connected to the first case 62. The structure omitting from the urging plate 104A to the joint member 193 can be employed. Further, in the structure omitting from the urging plate 104A to the joint member 193, the structure in which the third leg 213 and the third leg 233 are respectively connected to the first case 62 in the opposite side from the second leg 212 and the opposite side from the second leg 232 can be also employed. Accordingly, variations in the distance between the third leg 213 and the third leg 233 are easily suppressed so that variations in the postures of the first urging member 191 and variations in the postures of the second urging member 192 are easily suppressed. As a result, variations in the positions or the postures of the pressure receiving section 111 are easily suppressed so that it becomes easy to further stabilize the position or the posture of the pressure receiving section 111.

Further, in the urging plate 104A, the second leg 212 includes two of the leg 215A and the leg 215B, and the second leg 232 includes two of the leg 235A and the leg 235B. According to this structure, the oscillation of the pressure receiving section 111 in the direction of the alignment of two of the leg 215A and the leg 215B and in the direction of the alignment of two of the leg 235A and the leg 235B is easily suppressed. Therefore, it becomes easy to further stabilize the position or the posture of the pressure receiving section 111.

Further, in the urging plate 104A, the third leg 213 includes two of the leg 217A and the leg 217B, and the third leg 233 includes two of the leg 237A and the leg 237B. According to this structure, the oscillation of the pressure receiving section 111 in the direction of the alignment of two of the leg 217A and the leg 217B and in the direction of the alignment of two of the leg 237A and the leg 237B is easily suppressed. Therefore, it becomes easy to further stabilize the position or the posture of the pressure receiving section 111.

Further, in the urging plate 104A, the pressure receiving section 111, the first urging member 191, and the second urging member 192 are mutually and integrally formed so that the number of components can be reduced. Therefore, the cost for the cartridge 7 can be reduced. Also, for example, assembly errors of the pressure receiving section 111, the first urging member 191, and the second urging member 192 are easily solved in comparison with the case that the pressure receiving section 111, the first urging member 191, and the second urging member 192 are mutually configured in separate bodies.

Figure 20:
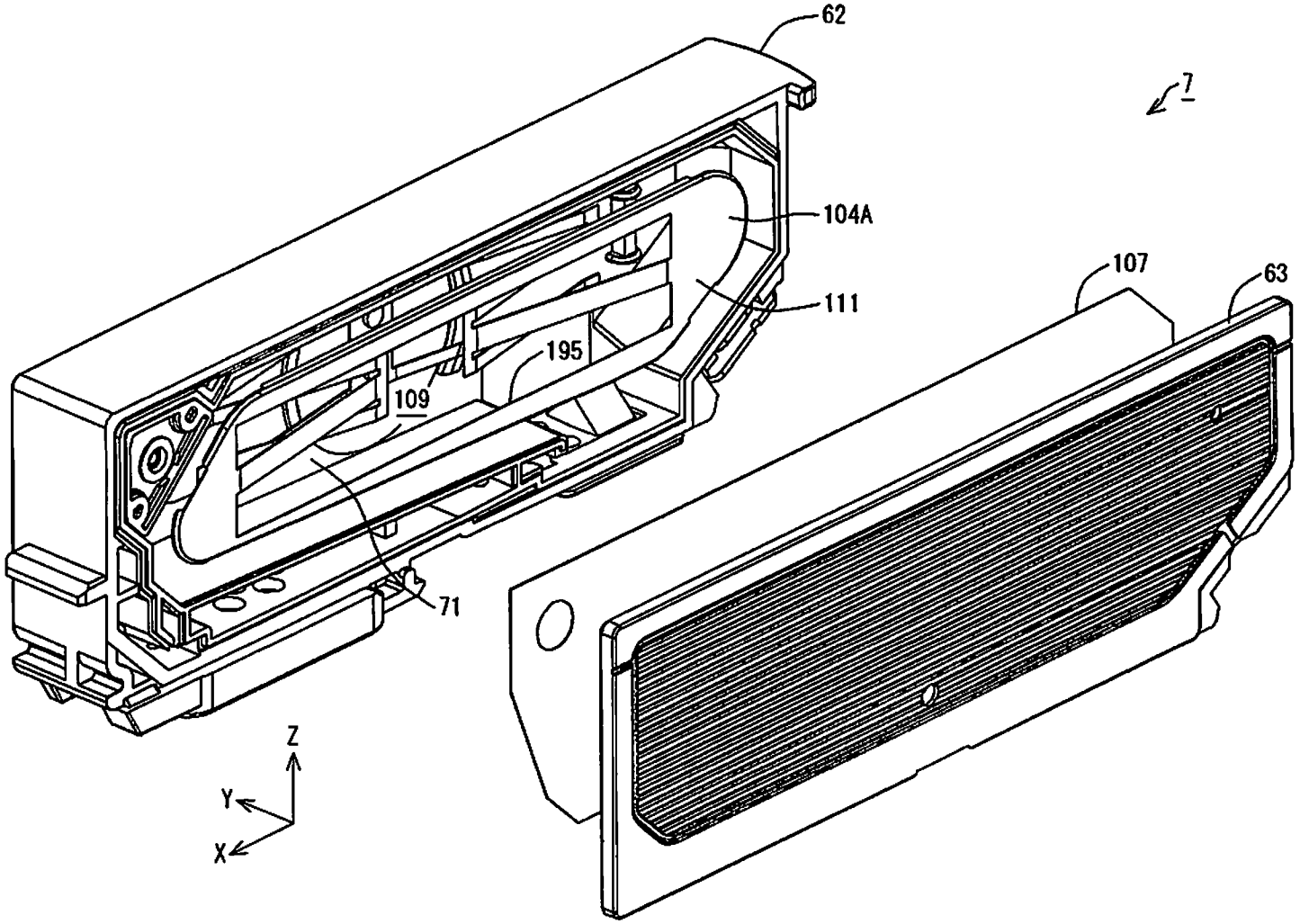
FIG. 20 is a perspective view showing the urging plate, the first case, the sheet member and the second case according to Example 1.

Further, in the urging plate 104A, in the state that the cartridge 7 is used in the printer 5, as shown in FIG. 20, the pressure receiving section 111 is placed along the XZ plane surface. That is, the opening section 195 extends along the XZ plane surface. The XZ plane surface intersects with the Y-axis direction which is the direction of which the carriage 17 reciprocates. The ink in the liquid containing section 109 enables to contact with the first wall 71, which is one of the inner walls intersecting with the Y-axis direction, and the sheet member 107, which is the other one of the inner walls intersecting with the Y-axis direction. Therefore, for example, when the ink in the liquid containing section 109 is oscillated in the Y-axis direction by the reason that the carriage 17 reciprocates along the Y-axis direction, the movement of the oscillated ink is easily absorbed in the sheet member 107. That is, when the ink in the liquid containing section 109 is oscillated, the impact by the oscillated ink can be absorbed in the sheet member 107.

Here, for example, among the inner walls of the liquid containing section 109, when any of the two inner walls through the ink in the Y-axis direction has higher rigidity than the sheet member 107, the ink in the liquid containing section 109 is easily foamed by colliding the ink, which is oscillated in the Y-axis direction, with the inner walls. On the other hand, in the urging plate 104A, even when the ink in the liquid containing section 109 is oscillated, the impact by the oscillated ink can be absorbed in the sheet member 107. Therefore, even when the ink in the liquid containing section 109 is oscillated, it suppresses that the ink in the liquid containing section 109 is foamed. As the opening section 195 in the pressure receiving section 111 is larger, it becomes easy to suppress that the ink in the liquid containing section is foamed.

Example 2

Figure 21:
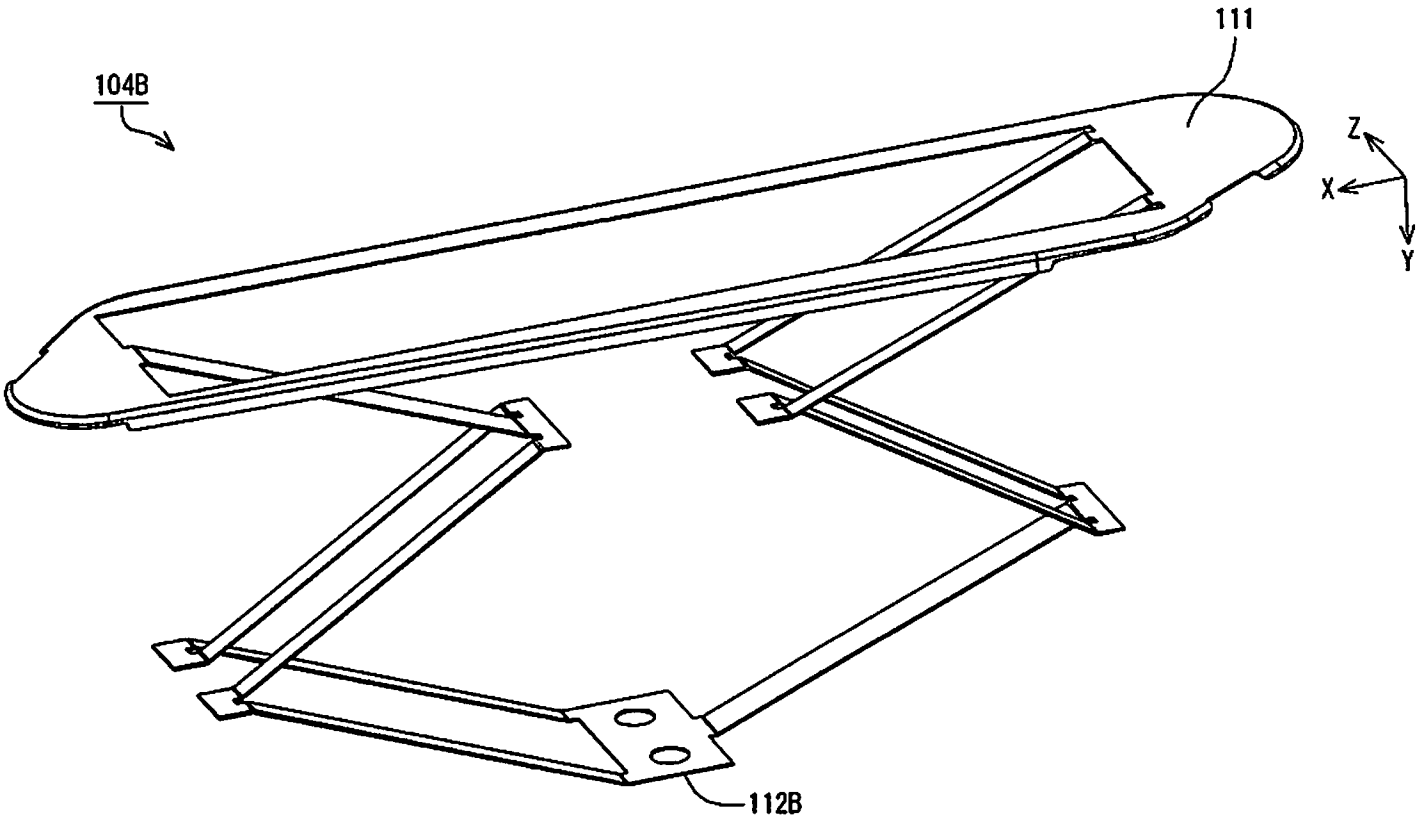
FIG. 21 is a perspective view showing the urging plate according to Example 2.
Figure 22:
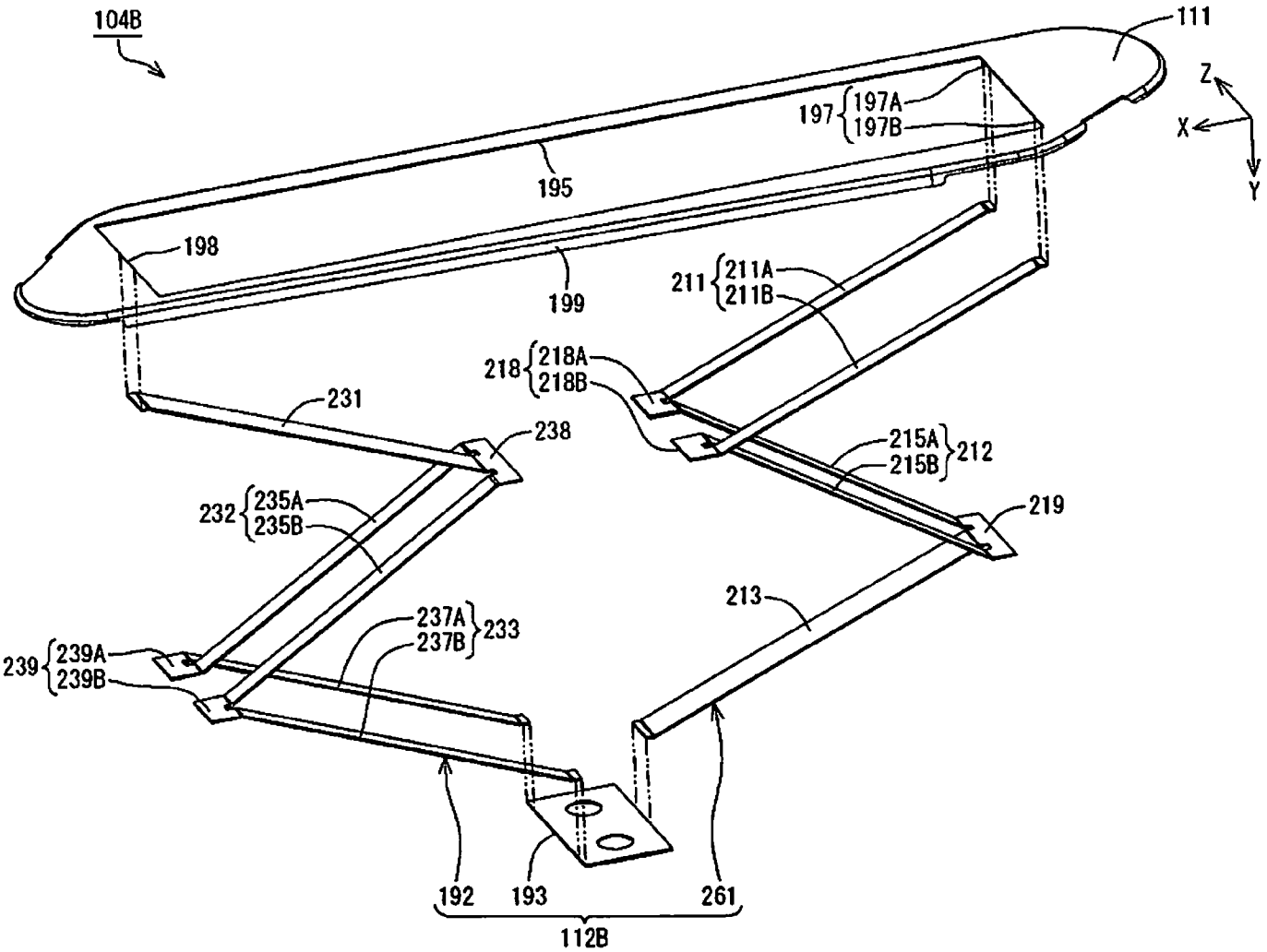
FIG. 22 is an exploded view when the urging plate according to Example 2 is cut into a plurality of parts.

An urging plate 104B in Example 2 will be described. As shown in FIG. 21, the urging plate 104B in Example 2 is provided with a pressure receiving section 111 and an urging section 112B. As shown in FIG. 22, the urging section 112B is provided with a first urging member 261. The urging plate 104B in Example 2 has the same structure as the urging plate 104A except the first urging member 191 (FIG. 12) of the urging plate 104A in Example 1 is replaced to the first urging member 261. Therefore, hereinafter, the parts having the same structure as those in Example 1 are assigned by the same reference numerals in Example 1 so that the description of those in detail will be omitted.

In the first urging member 261, the first leg 211 is provided with the leg 21 IA and the leg 211B. When the pressure receiving section 111 is viewed in the plane view, the leg 211A extends in the direction from the joint section 197A to the center side of the opening section 195, that is, in the direction from the edge side of the opening section 195 to the center side of the opening section 195. When the pressure receiving section 111 is viewed in the plane view, the leg 211B extends in the direction from the joint section 197B to the center side of the opening section 195, that is, in the direction from the edge side of the opening section 195 to the center side of the opening section 195.

The leg 211A and the leg 211B are aligned along the Z-axis direction. That is, the joint section 197A and the joint section 197B are aligned along the Z-axis direction. The leg 211A is connected to the leg 215A through the joint section 218A. Further, the leg 211B is connected to the leg 215B through the joint section 218B. The leg 215A and the leg 215B are respectively connected to the one third leg 213 through the joint section 219. Other parts are the same structure as Example 1.

The same effects as Example 1 can be obtained in Example 2. Further, in Example 2, the pressure receiving section 111 can be supported in three places of the joint section 197A, the joint section 197B, and the joint section 198. Therefore, it becomes easy to further stabilize the pressure receiving section 111 so that it becomes easy to further stabilize the position or the posture of the pressure receiving section 111.

Further, in Example 2, in the state that the pressure receiving section 111 is viewed in the plane view, the center of gravity of the pressure receiving section 111 is positioned within the region where the joint section 197A, the joint section 197B, and the joint section 198 are mutually connected. In other words, in the state that the pressure receiving section 111 is viewed in the plane view, the center of gravity of the pressure receiving section 111 is surrounded by the joint section 197A, the joint section 197B, and the joint section 198. Thus, the pressure receiving section 111 can be supported in three places surrounding the center of gravity of the pressure receiving section 111 so that it becomes easy to stably support the pressure receiving section 111. Therefore, it becomes easy to further stabilize the position or the posture of the pressure receiving section 111.

In Example 2, it shows an example that the first leg 211 is configured by two legs of the leg 211A and the leg 211B, and the one third leg 213. However, such structure can be employed to the second urging member 192. That is, as the structure of Example 2, the structure in which the first urging member 191 is provided, and the first leg 231, which includes two legs, and the one third leg 233 are provided can be employed.

Example 3

Figure 23:
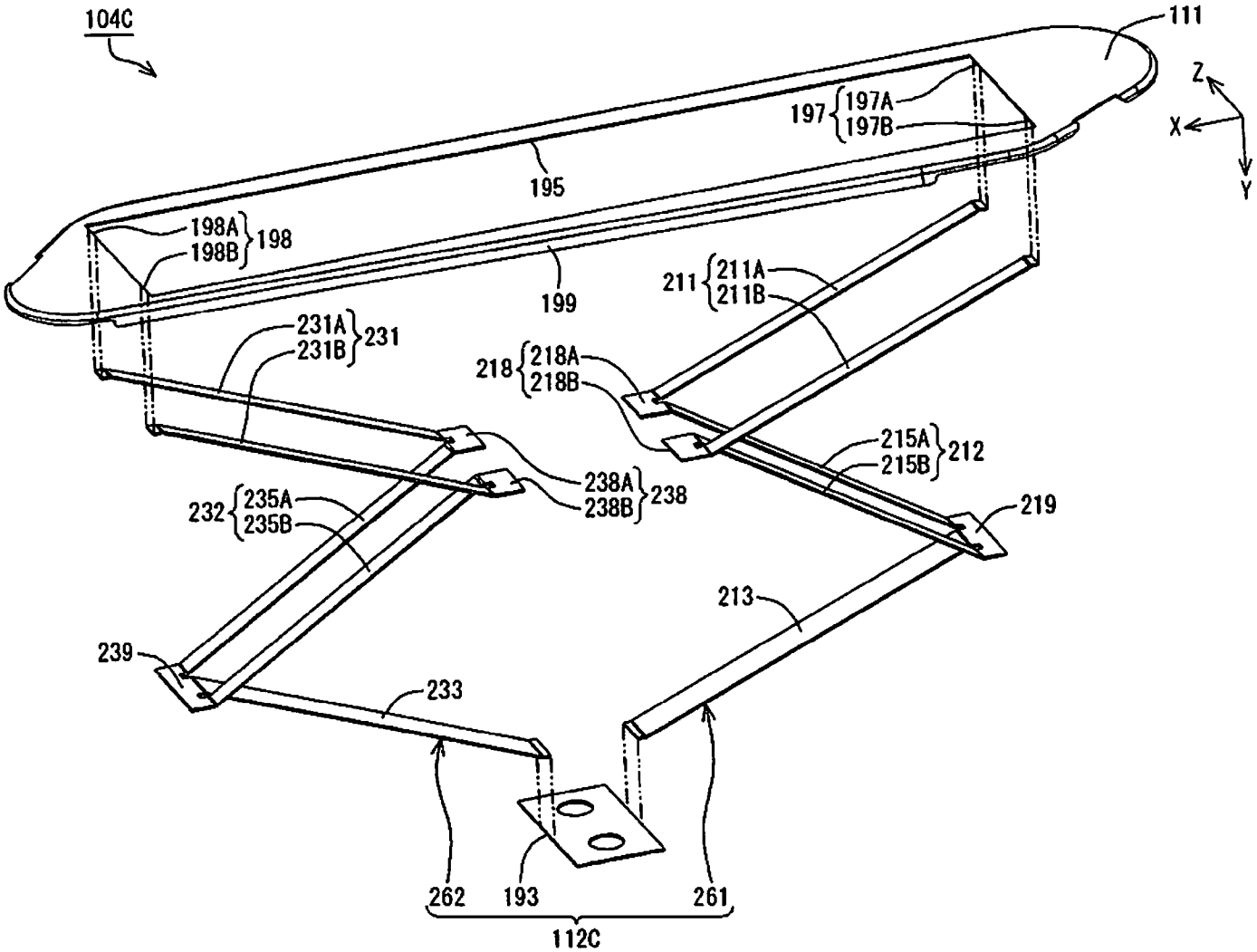
FIG. 23 is an exploded view when the urging plate according to Example 3 is cut into a plurality of parts.

Further, as shown in FIG. 23, the structure in which the first urging member 261 and the second urging member 262 are provided can be employed. An urging plate 104C having the first urging member 261 and the second urging member 262 is provided as Example 3. The urging plate 104C in Example 3 is provided with the pressure receiving section 111 and an urging section 112C. The urging section 112C is provided with the first urging member 261 and the second urging member 262. The urging plate 104C in Example 3 has the same structure as the urging plate 104B except the second urging member 192 (FIG. 22) of the urging plate 104B in Example 2 is replaced to the second urging member 262. Therefore, hereinafter, the parts having the same structure as those in Example 2 are assigned by the same reference numerals in Example 2 so that the description of those in detail will be omitted.

In the second urging member 262, the first leg 231 is provided with the leg 231A and the leg 231B. When the pressure receiving section 111 is viewed in the plane view, the leg 231A extends in the direction from the joint section 198A to the center side of the opening section 195, that is, in the direction from the edge side of the opening section 195 to the center side of the opening section 195. When the pressure receiving section 111 is viewed in the plane view, the leg 231B extends in the direction from the joint section 198B to the center side of the opening section 195, that is, in the direction from the edge side of the opening section 195 to the center side of the opening section 195.

The leg 231A and the leg 231B are aligned along the Z-axis direction. Thus, the joint section 198A and the joint section 198B are aligned along the Z-axis direction. The leg 231A is connected to the leg 235A through the joint section 238A. Further, the leg 231B is connected to the leg 235B through the joint section 238B. The leg 235A and the leg 235B are respectively connected to the one third leg 233 through the joint section 239. Other parts are the same structure as Example 2.

The same effects as Example 2 can be obtained in Example 3. Further, in Example 3, the pressure receiving section 111 can be supported in four places of the joint section 197A, the joint section 197B, the joint section 198A, and the joint section 198B. Therefore, it becomes easy to further stabilize and support the pressure reviving section 111 so that it becomes easy to further stabilize the position or the posture of the pressure receiving section 111.

Further, in Example 3, in the state that the pressure receiving section 111 is viewed in the plane view, the center of gravity of the pressure receiving section 111 is positioned within the region where the joint section 197A, the joint section 197B, the joint section 198A, and the joint section 198B are mutually connected along the edge of the opening section 195. In other words, in the state that the pressure receiving section 111 is viewed in the plane view, the center of gravity of the pressure receiving section 111 is surrounded by the joint section 197A, the joint section 197B, the joint section 198A, and the joint section 198B. Thus, the pressure receiving section 111 can be supported in four places surrounding the center of gravity of the pressure receiving section 111 so that it becomes easy to stabilize and support the pressure receiving section 111. Therefore, it becomes easy to further stabilize the position or the posture of the pressure receiving section 111.

Example 4

Figure 24:
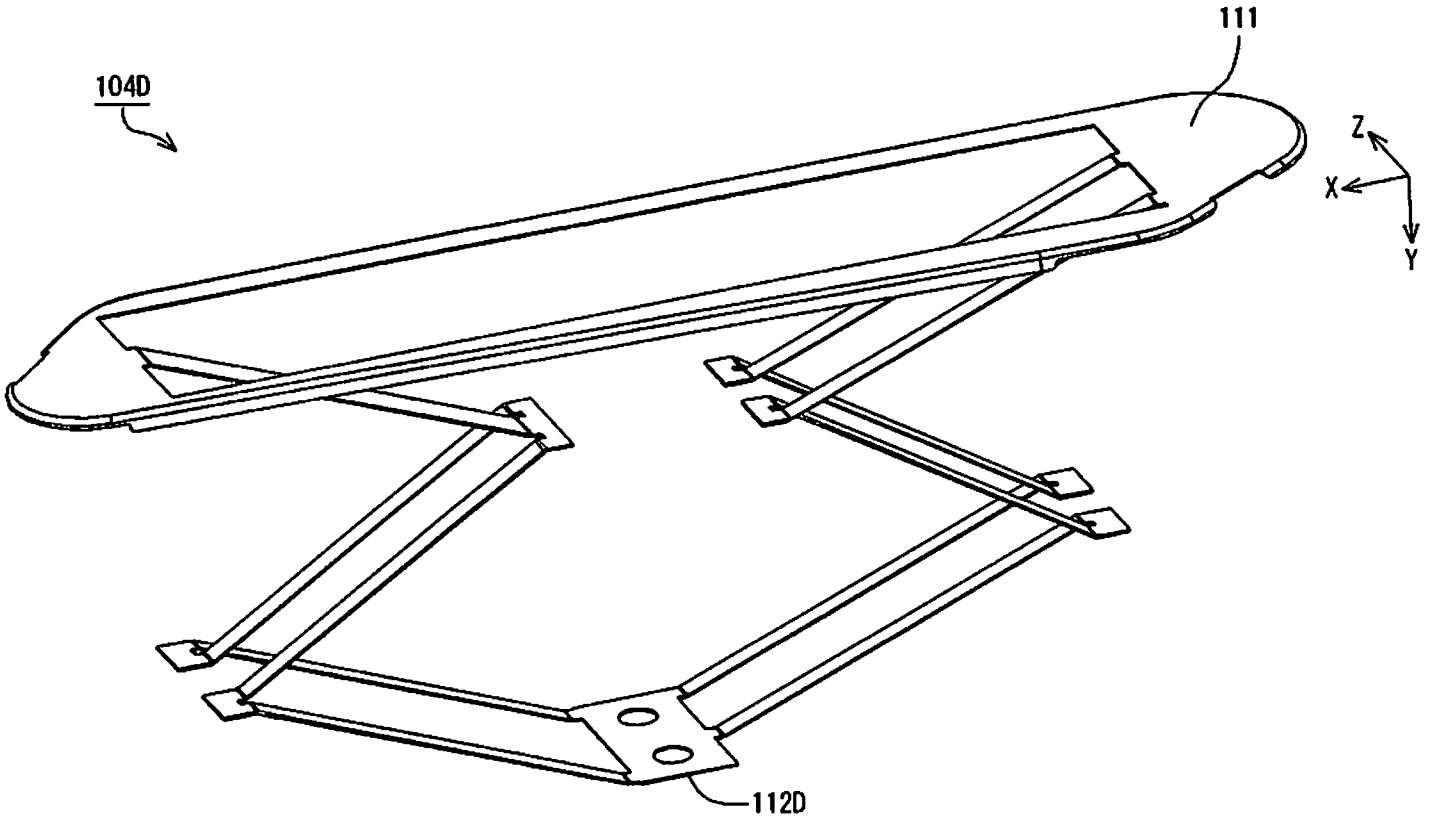
FIG. 24 is a perspective view showing the urging plate according to Example 4.
Figure 25:
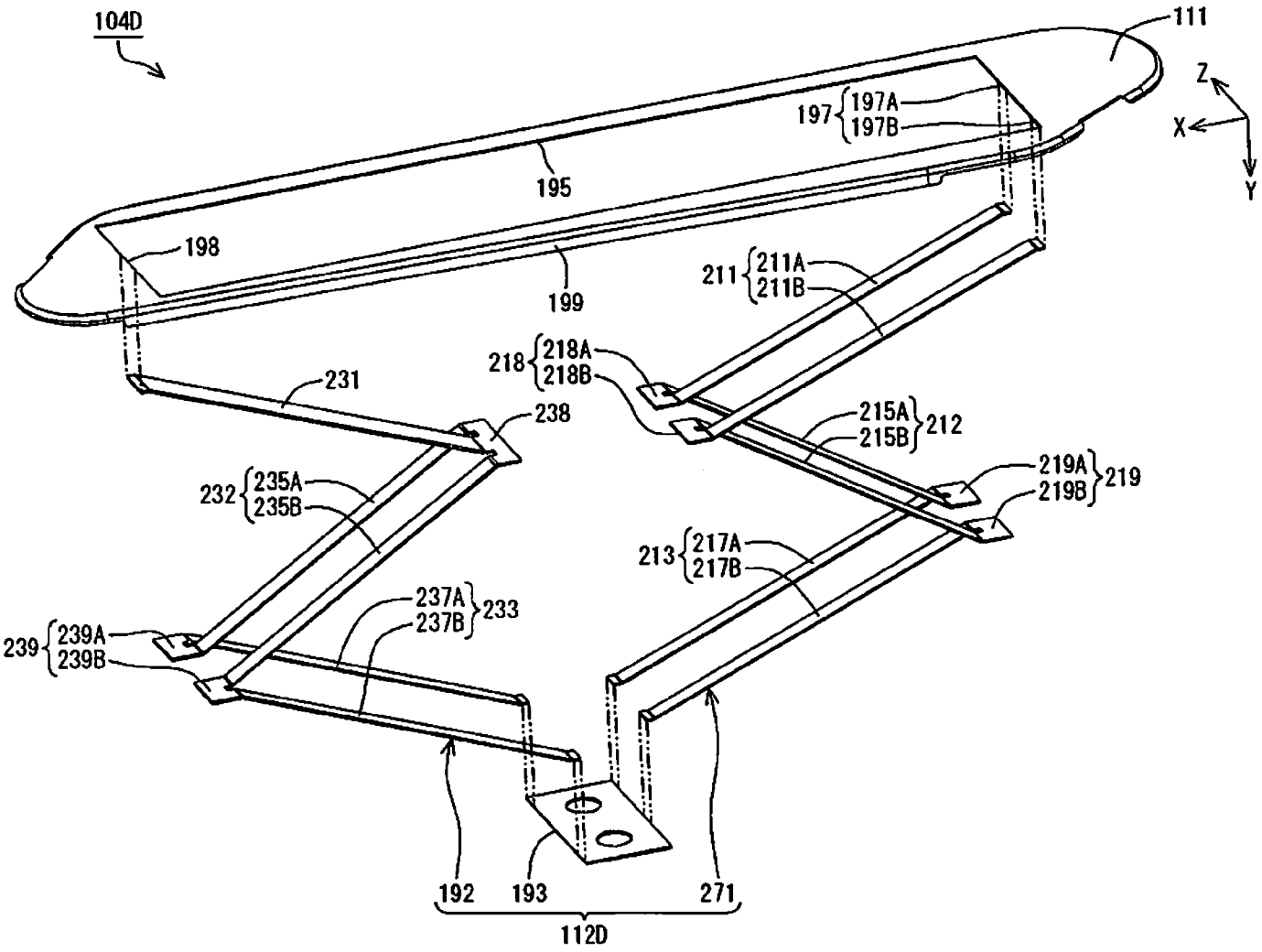
FIG. 25 is an exploded view when the urging plate according to Example 4 is cut into a plurality of parts.

An urging plate 104D in Example 4 will be described. As shown in FIG. 24, the urging plate 104D in Example 4 is provided with the pressure receiving section 111 and an urging section 112D. As shown in FIG. 25, the urging section 112D is provided with a first urging member 271. The urging plate 104D in Example 4 has the same structure as the urging plate 104A except the first urging member 191 (FIG. 12) of the urging plate 104A in Example 1 is replaced with the first urging member 271. Therefore, hereinafter, the parts having the same structure as those in Example 1 are assigned by the same reference numerals in Example 1 so that the description of those in detail will be omitted.

In the first urging member 271, the first leg 211 is provided with the leg 21 IA and the leg 211B. When the pressure receiving section 111 is viewed in the plane view, the leg 211A extends in the direction from the joint section 197A to the center side of the opening section 195, that is, in the direction from the edge side of the opening section 195 to the center side of the opening section 195. When the pressure receiving section 111 is viewed in the plane view, the leg 211B extends in the direction from the joint section 197B to the center side of the opening section 195, that is, in the direction from the edge side of the opening section 195 to the center side of the opening section 195.

The leg 211A and the leg 211B are aligned along the Z-axis direction. Therefore, the joint section 197A and the joint section 197B are aligned along the Z-axis direction. The leg 211A is connected to the leg 215A of the second leg 212 through the joint section 218A. Further, the leg 211B is connected to the leg 215B of the second leg 212 through the joint section 218B. The leg 215A is connected to the leg 217A of the third leg 213 through the joint section 219A. The leg 215B is connected to the leg 217B of the third leg 213 through the joint section 219B. Other parts are the same structure as Example 1.

The same effects as Example 1 can be obtained in Example 4. Further, in Example 4, the pressure receiving section 111 can be supported in three places of the joint section 197A, the joint section 197B, and the joint section 198. Therefore, it becomes easy to further stabilize and support the pressure receiving section 111 so that it becomes easy to further stabilize the position or the posture of the pressure receiving section 111.

Further, in Example 4, the third leg 213 is also configured by two legs of the leg 217A and the leg 217B. Thus, the strength with respect to the torsion of the third leg 213 is enhanced. Accordingly, the oscillation of the pressure receiving section 111 in the direction of the alignment of two of the leg 217A and the leg 217B is easily suppressed. Therefore, it becomes easy to further stabilize the position or the posture of the pressure receiving section 111.

Further, in Example 4, in the state that the pressure receiving section 111 is viewed in the plane view, the center of gravity of the pressure receiving section 111 is positioned within the region where the joint section 197A, the joint section 197B, and the joint section 198 are mutually connected. In other words, in the state that the pressure receiving section 111 is viewed in the plane view, the center of gravity of the pressure receiving section 111 is surrounded by the joint section 197A, the joint section 197B, and the joint section 198. Thus, the pressure receiving section 111 can be supported in three places surrounding the center of gravity of the pressure receiving section 111 so that it becomes easy to stabilize and support the pressure receiving section 111. Therefore, it becomes easy to further stabilize the position or the posture of the pressure receiving section 111.

In Example 4, it shows an example that the first leg 211, the second leg 212, and the third leg 213 are respectively configured by two legs. However, such structure can be employed to the second urging member 192. That is, as the structure of Example 4, the structure in which the first urging member 191 is provided, and the first leg 231, the second leg 232, and the third leg 233 respectively include two legs can be employed.

Example 5

Figure 26:
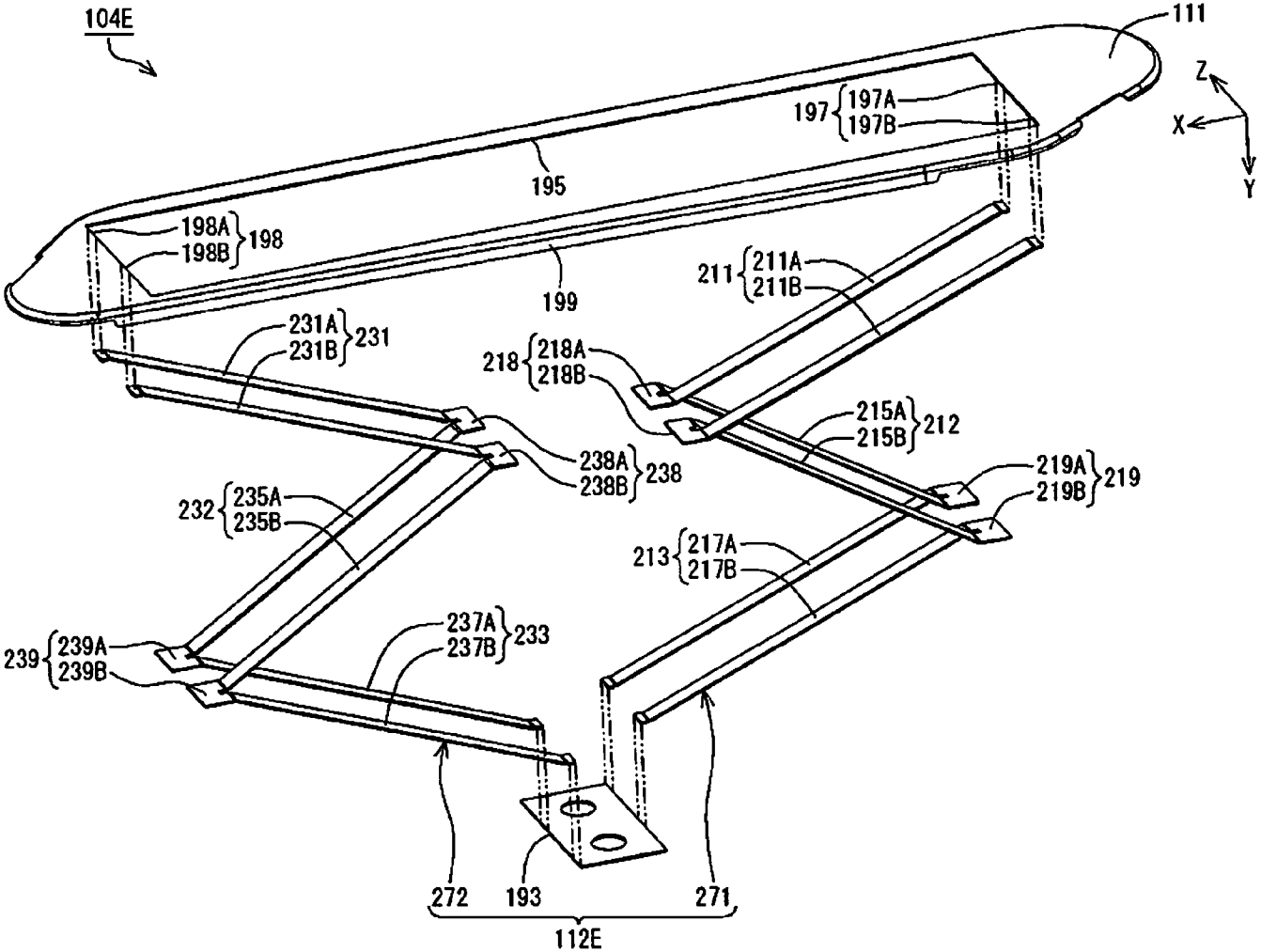
FIG. 26 is an exploded view when the urging plate according to Example 5 is cut into a plurality of parts.

Further, as shown in FIG. 26, the structure in which the first urging member 271 and the second urging member 272 are provided can be employed. An urging plate 104E having the first urging member 271 and the second urging member 272 is provided as Example 5. The urging plate 104E in Example 5 is provided with the pressure receiving section 111 and an urging section 112E. The urging section 112E is provided with the first urging member 271 and the second urging member 272. The urging plate 104E in Example 5 has the same structure as the urging plate 104D except the second urging member 192 (FIG. 24) of the urging plate 104D in Example 4 is replaced with the second urging member 272. Therefore, hereinafter, the parts having the same structure as those in Example 4 are assigned by the same reference numerals in Example 4 so that the description of those in detail will be omitted.

In the second urging member 272, the first leg 231 is provided with the leg 231A and the leg 231B. When the pressure receiving section 111 is viewed in the plane view, the leg 231A extends in the direction from the joint section 198A to the center side of the opening section 195, that is, in the direction from the edge side of the opening section 195 to the center side of the opening section 195. When the pressure receiving section 111 is viewed in the plane view, the leg 231B extends in the direction from the joint section 198B to the center side of the opening section 195, that is, in the direction from the edge side of the opening section 195 to the center side of the opening section 195.

The leg 231A and the leg 231B are aligned along the Z-axis direction. Thus, the joint section 198A and the joint section 198B are aligned along the Z-axis direction. The leg 231A is connected to the leg 235A of the second leg 232 through the joint section 238A. Also, the leg 231B is connected to the leg 235B of the second leg 232 through the joint section 238B. The leg 235A is connected to the leg 237A of the third leg 233 through the joint section 239A. The leg 235B is connected to the leg 237B of the third leg 233 through the joint section 239B. Other parts are the same structure as Example 1.

The same effects as Example 4 can be obtained in Example 5. Further, in Example 5, the third leg 233 is configured by two legs of the leg 237A and the 237B. Thus, the strength with respect to the torsion of the third leg 233 is enhanced. Accordingly, the oscillation of the pressure receiving section 111 in the direction of the alignment of two of the leg 237A and the leg 237B is easily suppressed. Therefore, it becomes easy to further stabilize the position or the posture of the pressure receiving section 111.

Further, in Example 5, in the state that the pressure receiving section 111 is viewed in the plane view, the center of gravity of the pressure receiving section 111 is positioned within the region where the joint section 197A, the joint section 197B, the joint section 198A, and the joint section 198B are mutually connected along the edge of the opening section 195. In other words, in the state that the pressure receiving section 111 is viewed in the plane view, the center of gravity of the pressure receiving section 111 is surrounded by the joint section 197A, the joint section 197B, the joint section 198A, and the joint section 198B. Thus, the pressure receiving section 111 can be supported in the four places surrounding the center of gravity of the pressure receiving section 111 so that it becomes easy to stabilize and support the pressure receiving section 111. Therefore, it becomes easy to further stabilize the position or the posture of the pressure receiving section 111.

Example 6

Figure 27:
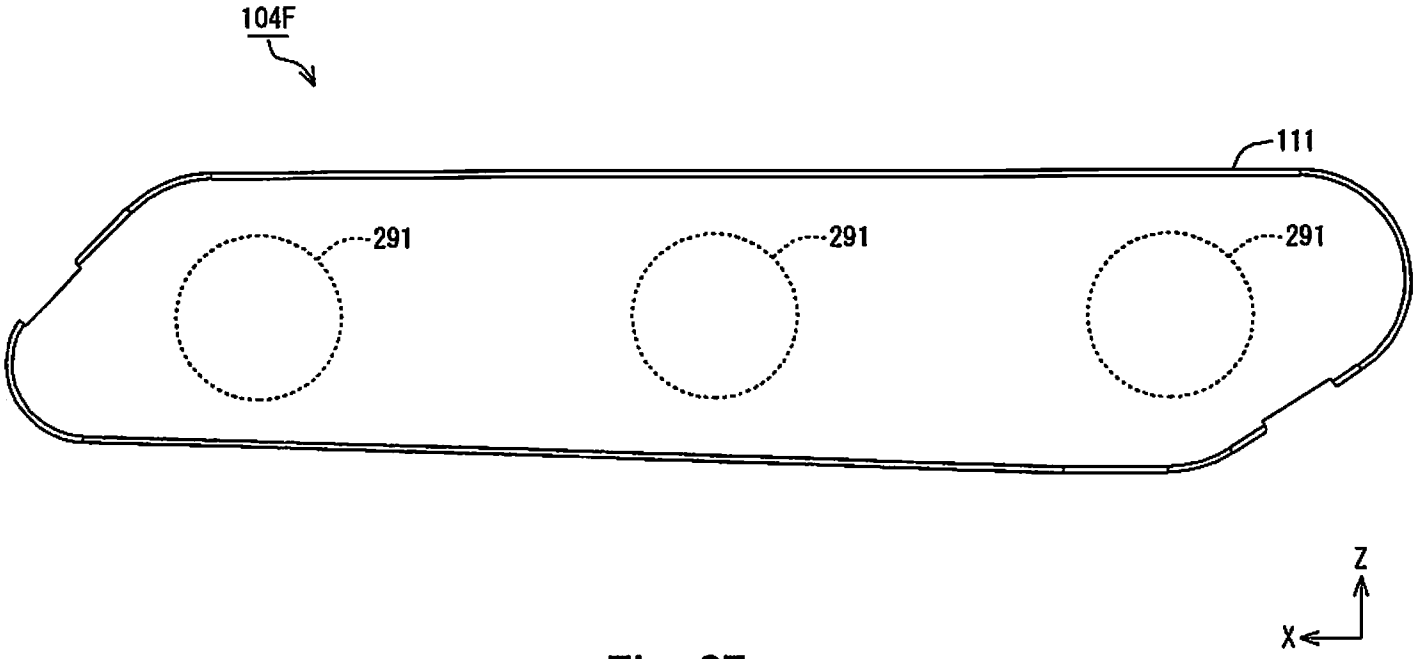
FIG. 27 is a plane view showing the urging plate according to Example 6.

In view of the increase of the supporting places for the pressure receiving section 111, as shown in FIG. 27, the structure in which the pressure receiving section 111 is urged by a plurality of springs 291 can be employed. The structure in which the pressure receiving section 111 is urged by the plurality of springs 291 is provided as Example 6. In the urging plate 104F of Example 6, the pressure receiving section 111 and the plurality of springs 291 are mutually configured in separate bodies. FIG. 27 shows an example having three springs 291 as the plurality of springs 291. As the spring 291, for example, a coil spring that is wound in a truncated cone shape is employed. In the case that it is the coil spring wound in a truncated cone shape, the height dimension of the springs 291 is easily suppressed to have smaller dimension when the springs 291 are contracted. Therefore, the shrinkage of the volume of the liquid containing section 109 can be larger. In Example 6, the pressure receiving section 111 can be supported in the plurality of places. Therefore, it becomes easy to stabilize and support the pressure receiving section 111 so that it becomes easy to stabilize the position or the posture of the pressure receiving section 111.

The present invention is not limited to the ink-jet printer and its ink cartridge but is applicable to any of printing devices and cartridges to eject a liquid other than ink. For example, this is applicable to various printing devices and their cartridges as follows: (1) an image recording apparatus, such as a facsimile machine; (2) a printing device configured to eject color material used to manufacture color filters for image display devices, e.g., liquid crystal displays; (3) a printing device configured to eject electrode material used to form electrodes of, for example, organic EL (electroluminescence) displays and field emission displays (FED); (4) a printing device configured to eject a bioorganic material-containing liquid used to manufacture biochips; (5) a specimen printing apparatus used as a precision pipette; (6) a printing device of lubricant; (7) a printing device of resin solution; (8) a printing device for pinpoint ejection of lubricant at precision machinery including timepieces and cameras; (9) a printing device configured to eject transparent resin solution, such as ultraviolet curable resin solution, onto the substrate, so as to manufacture a micro-hemispherical lens (optical lens) used for optical communication elements etc.; (10) a printing device configured to eject an acidic or alkaline etching solution, in order to etch the substrate; and (11) a printing device equipped with liquid ejecting head for ejecting a very small volume of droplets of another arbitrary liquid.

The droplet means a state of the liquid which is ejected from the liquid ejecting apparatus and includes granular, tear-like and pulled into a thread-like tail. In addition, the so-called liquid may be a material which the liquid ejecting apparatus may eject. For example, the liquid may be acceptable if the substance is in a state of liquid phase. Liquid-like bodies with high or low viscosity, sol, gel water, other inorganic solvents, organic solvents, solutions, liquid resins and liquid metals (metallic melt) may be included. In addition, without being limited to liquid as a state of substance, anything in which particles of functional material formed from solid materials such as pigments or metal particles are dissolved, dispersed or mixed in a solvent may be included. The liquid as described above can be expressed as liquid body. Further, an ink, a liquid crystal, etc. as described in the aforementioned examples may be mentioned as a typical example of the liquid or the liquid body. Herein, the ink includes various liquid compositions such as a general aqueous ink, oil-based ink, gel ink, hot melt ink, etc.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A liquid storing container having a liquid containing section configured to store liquid, the liquid storing container being configured to supply the liquid in the liquid containing section to a liquid ejecting device, the liquid storing container comprising:

a case constituting a part of an inner wall of the liquid containing section;

a flexible member having flexibility and constituting at least a part of a remaining inner wall of the liquid containing section;

a pressure receiving member arranged between the case and the flexible member in the liquid containing section;

a first urging member provided between the pressure receiving member and the case, one end of the first urging member being connected to the pressure receiving member at a first joint portion, the first urging member being configured to urge the pressure receiving member from the case to the flexible member in an urging direction;

a second urging member provided between the pressure receiving member and the case, one end of the second urging member being connected to the pressure receiving member at a second joint portion, the second urging member being configured to urge the pressure receiving member from the case to the flexible member in the urging direction; and a plate-shaped joint member connected to the other end of the first urging member and the other end of the second urging member, the plate-shaped joint member further being connected to the case, the pressure receiving member facing the flexible member so as to contact the flexible member, the first urging member, the second urging member, and an entire of the plate-shaped joint member being arranged inside of an outer contour of the pressure receiving member as viewed in the urging direction, the first urging member, the second urging member, and the entire of the plate-shaped joint member other than the first joint portion and the second joint portion being not overlapped with the pressure receiving member as viewed in the urging direction.

2. The liquid storing container according to claim 1, wherein the pressure receiving member is formed in a plate shape, each of the first urging member and the second urging member has a first leg and a second leg, one end of the first leg being connected to the pressure receiving member, the first leg extending in a state of an inclination with respect to the pressure receiving member, the other end of the first leg being connected to one end of the second leg, and the second leg extending in a state of an inclination with respect to the pressure receiving member, the first leg is inclined in a direction approaching from the pressure receiving member to the case, and the second leg is inclined in a direction approaching from the first leg to the case and is further inclined in an opposite direction from a direction of the inclination of the first leg.

3. The liquid storing container according to claim 2, wherein the first joint portion jointed between the pressure receiving member and the first leg of the first urging member and the second joint portion jointed between the pressure receiving member and the first leg of the second urging member are positioned opposite to each other relative to a center of gravity of the pressure receiving member.

4. The liquid storing container according to claim 2, wherein each of the first urging member and the second urging member further has a third leg which is connected to the other end of the second leg and extends in a state of an inclination with respect to the pressure receiving member, and the third leg is inclined in a direction approaching from the second leg to the case, and is further inclined in an opposite direction from a direction of the inclination of the second leg.

5. The liquid storing container according to claim 2, wherein an inclination direction of the first leg of the first urging member and an inclination direction of the first leg of the second urging member are opposite to each other.

6. The liquid storing container according to claim 2, wherein the first leg extends in a direction from an outer side of the pressure receiving member to a center side as the pressure receiving member is viewed in a plane view, and is inclined in a direction approaching to the case while being directed from the outer side of the pressure receiving member to the center side.

7. The liquid storing container according to claim 4, wherein the third leg of the first urging member and the third leg of the second urging member are connected to each other through the plate-shaped joint member.

8. The liquid storing container according to claim 7, wherein the third leg of the first urging member and the third leg of the second urging member are connected to each other through the plate-shaped joint member.

9. The liquid storing container according to claim 4, wherein the third leg of the first urging member and the third leg of the second urging member are connected to the case.

10. The liquid storing container according to claim 4, wherein the second leg has two legs.

11. The liquid storing container according to claim 4, wherein the third leg has two legs.

12. The liquid storing container according to claim 2, wherein at least one of the first leg of the first urging member and the first leg of the second urging member has two legs.

13. The liquid storing container according to claim 1, wherein the pressure receiving member, the first urging member, and the second urging member are a one-piece unitary member.

14. The liquid storing container according to claim 1, further comprising a third urging member provided between the pressure receiving member and the case, one end of the third urging member being connected to the pressure receiving member, the third urging member being configured to urge the pressure receiving member from the case to the flexible member.

15. The liquid storing container according to claim 1, wherein the pressure receiving member has a single opening.

* * * * *